United States Patent [19]

Parham, Jr. et al.

[11] 4,320,876

[45] Mar. 23, 1982

[54] SELECTIVELY WINDING STRANDS ON A SUPPORT MEMBER

[75] Inventors: Donald W. Parham, Jr., Jamestown; John G. Tucker, Lexington, both of N.C.

[73] Assignee: Western Electric Company, Inc., New York, N.Y.

[21] Appl. No.: 85,099

[22] Filed: Oct. 15, 1979

[51] Int. Cl.[3] ..... B21C 47/10

[52] U.S. Cl. ..... 242/7.11; 140/92.1; 242/7.09; 242/7.13; 242/7.14; 242/7.17

[58] Field of Search ..... 242/7.09, 7.11, 7.14, 242/7.05 B, 1.1 R, 27, 25 A, 78 A, 7.17, 7.18, 7.06, 365 R; 140/92.1 R

[56] References Cited

U.S. PATENT DOCUMENTS

| | | | |
|---|---|---|---|
| 2,713,599 | 1/1973 | Smith et al. | 242/7.11 |
| 3,019,822 | 2/1962 | Jacobson | 242/7.17 |
| 3,090,569 | 5/1963 | Beushausen | 242/25 A |
| 3,273,811 | 9/1966 | Mueller | 242/7.09 |
| 3,314,452 | 4/1967 | Cartwright et al. | 140/92.2 |
| 3,327,736 | 6/1967 | Depuy | 242/27 |
| 3,445,074 | 5/1969 | DiMeglio | 242/27 |
| 3,903,593 | 9/1975 | Mason | 242/1.1 R |
| 3,927,469 | 12/1975 | Dammar | 242/7.05 B |
| 3,980,243 | 9/1976 | Schulman | 242/7.05 B |
| 4,185,789 | 1/1980 | Camardella | 242/7.14 |

*Primary Examiner*—Billy S. Taylor

*Attorney, Agent, or Firm*—D. D. Bosben

[57] ABSTRACT

Wires (30-1, 30-2, 30-3 and 30-4), which may be of different gauges, are selectively wound on bobbins (32) either singly or in parallel with one another. More specifically, wire guides (364) for first wires (30-1) are selectively transferable between a wire wrapping plate (222) for a bobbin winding operation, and inoperative positions on a storage block (71). Similarly, wire guides (428) for the additional wires (30-2, 30-3 and 30-4) are selectively transferable between the wire wrapping plate (222) for a bobbin winding operation, and inoperative positions in a magazine storage assembly (66). The wrapping radius of the wrapping plate (222) also is adjustable to accommodate bobbins (32) having different terminal spacings.

26 Claims, 40 Drawing Figures

FIG. 12
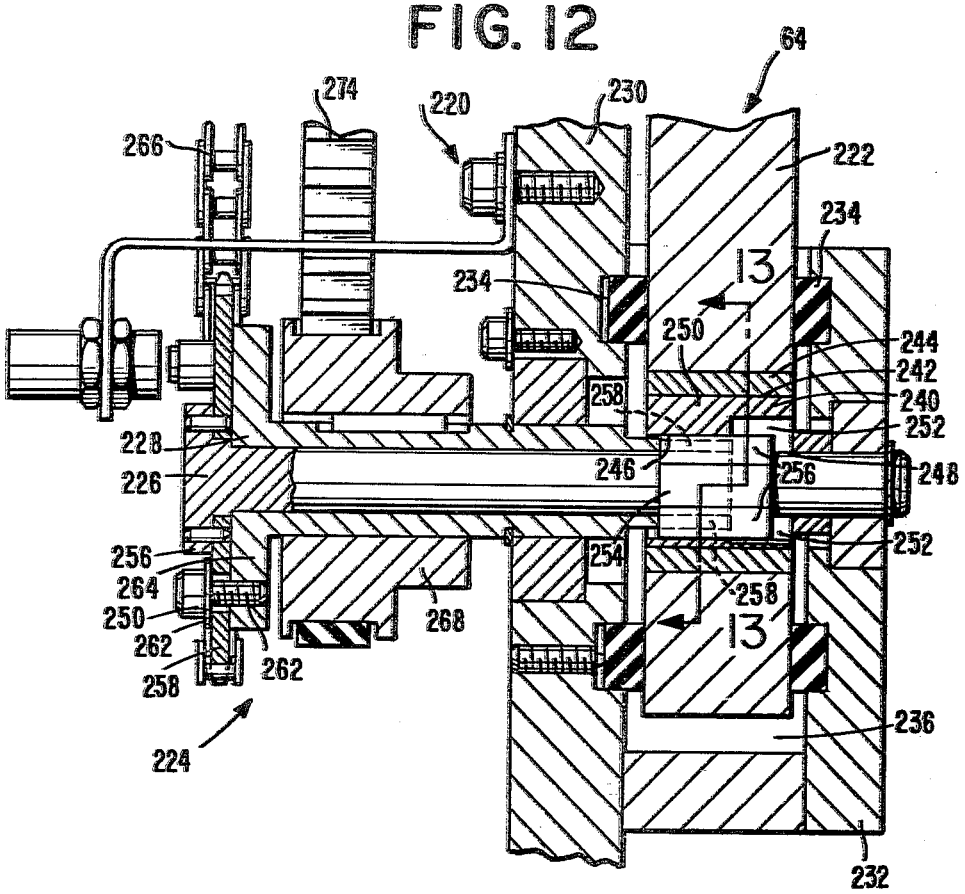
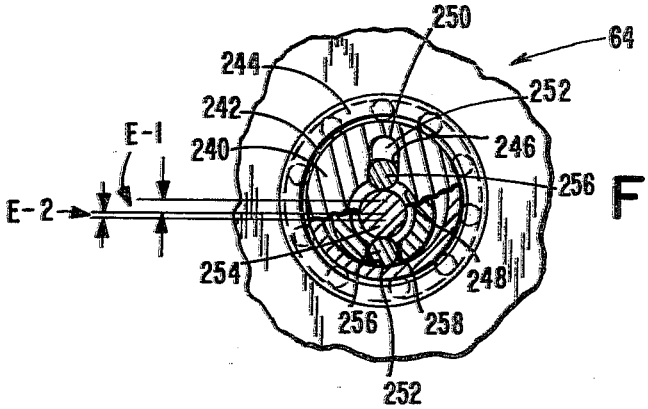
FIG. 13

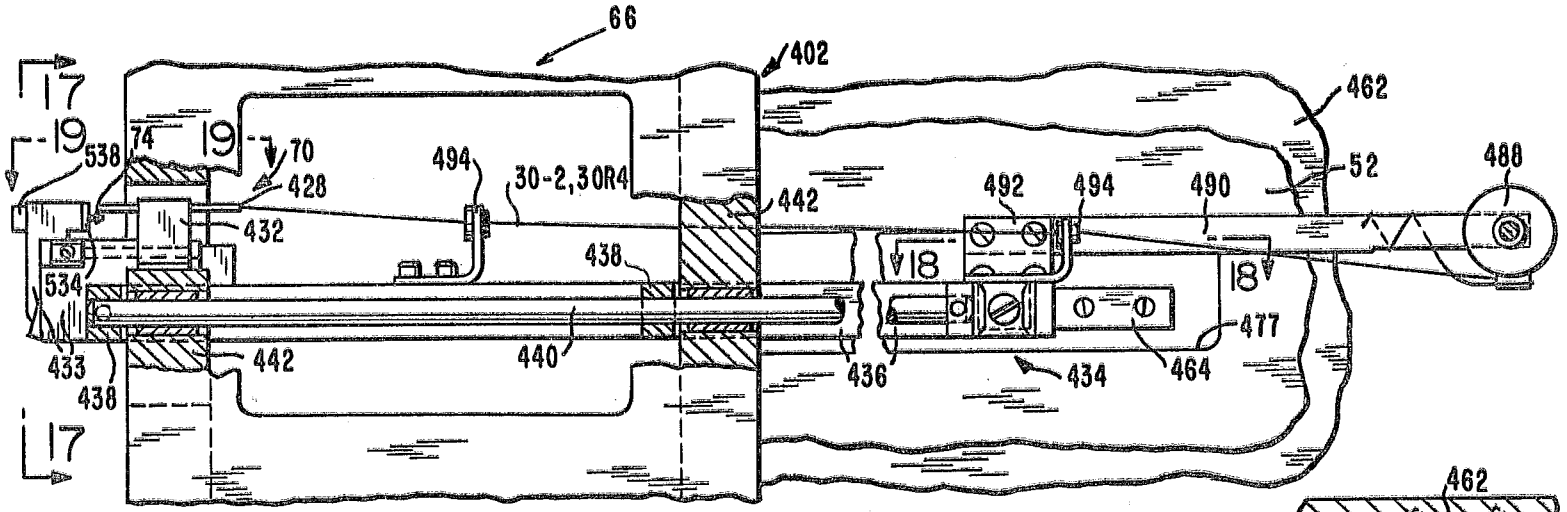
FIG. 16
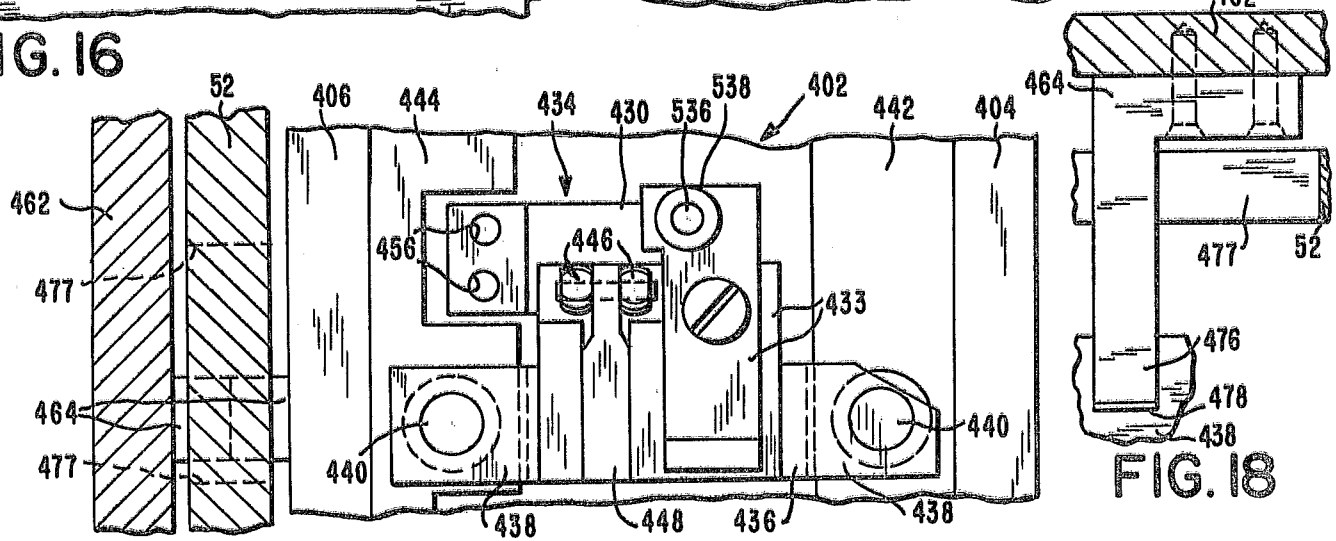
FIG. 18
FIG. 17

FIG. 19
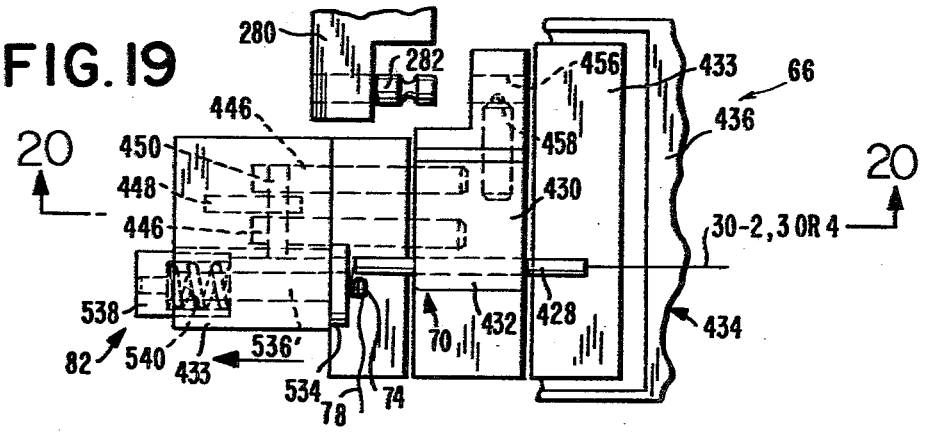
FIG. 20
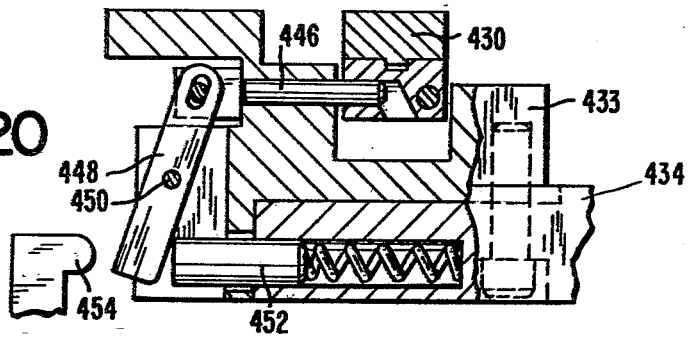
FIG. 21
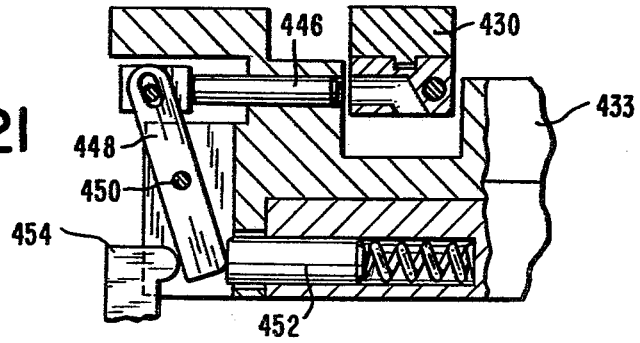
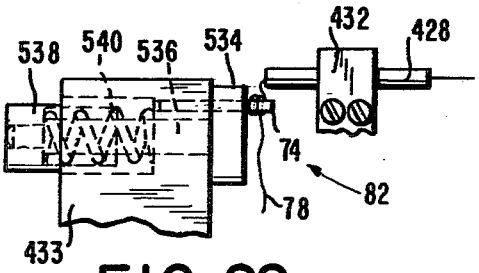
FIG. 22
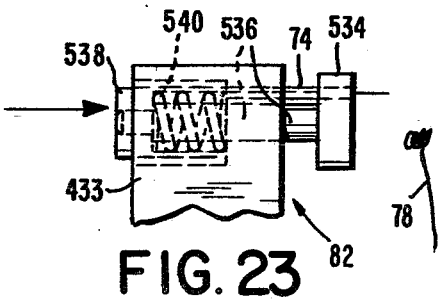
FIG. 23

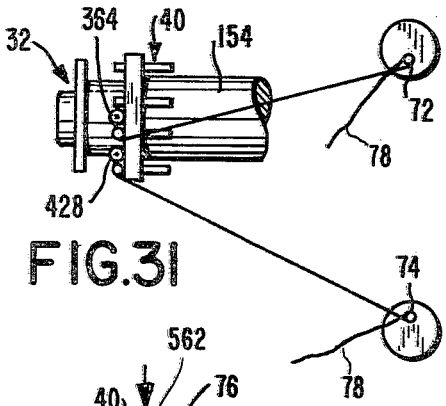
FIG.31
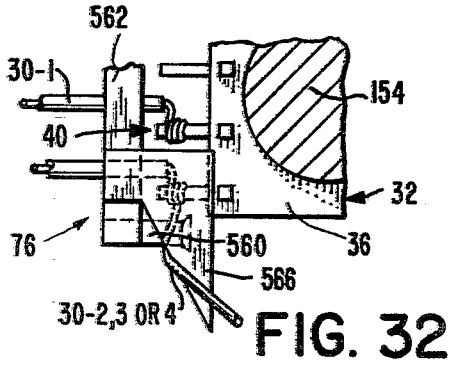
FIG. 32
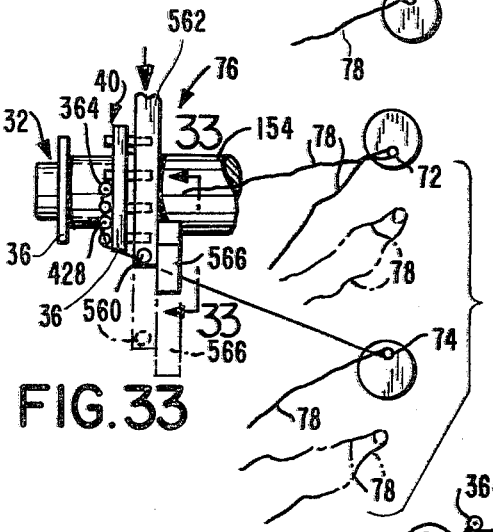
FIG.33
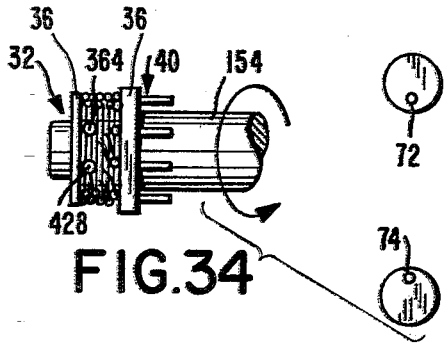
FIG.34
FIG.35
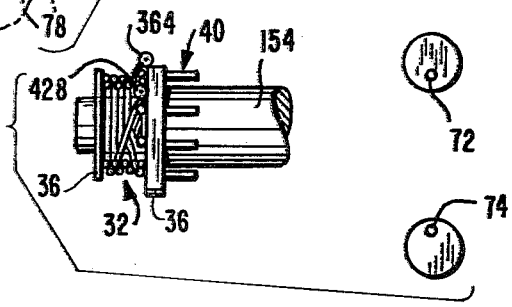
FIG. 36
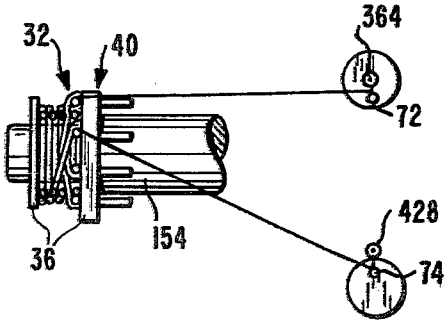

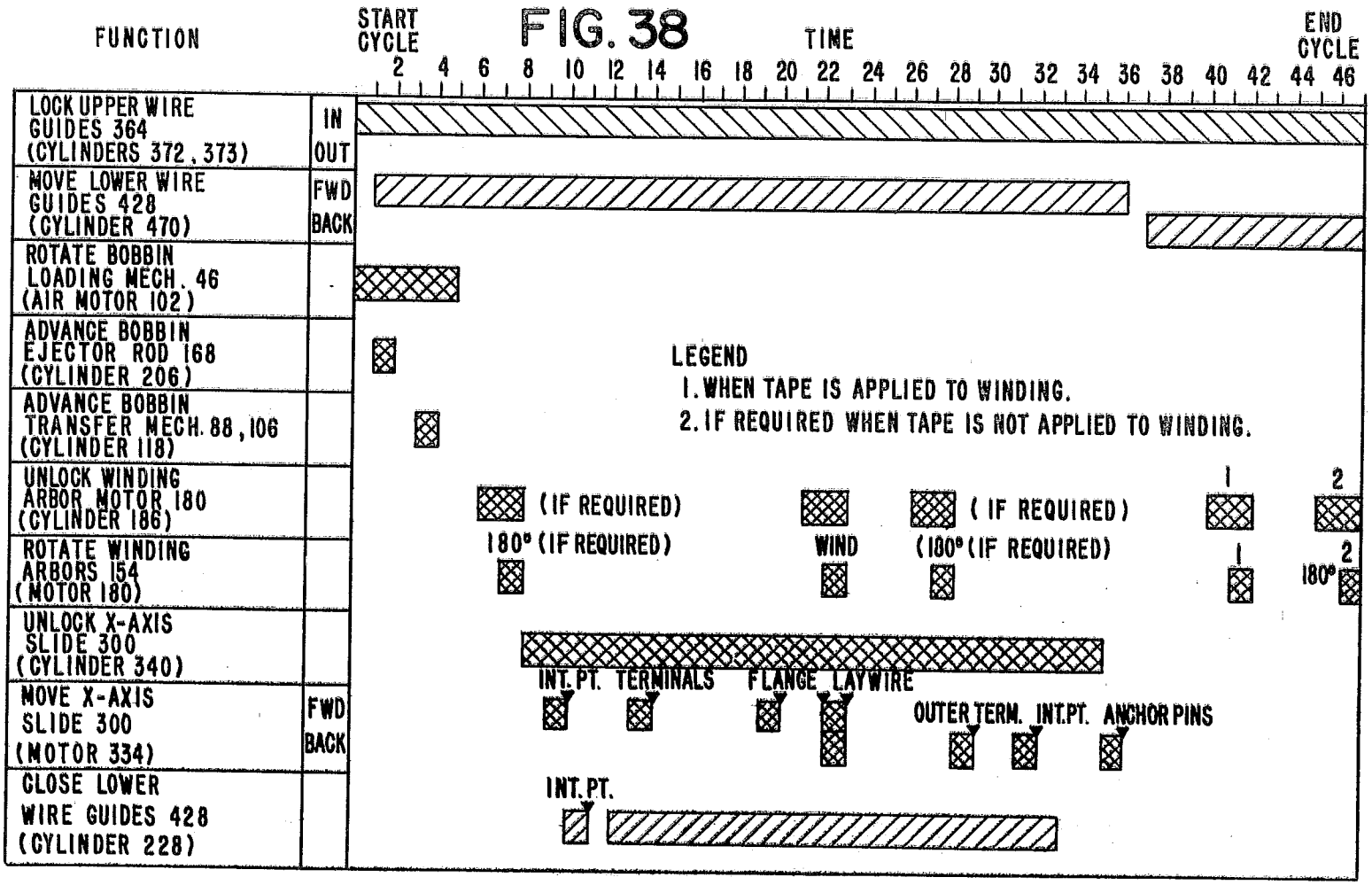
FIG. 38
TIME
START CYCLE
END CYCLE
2 4 6 8 10 12 14 16 18 20 22 24 26 28 30 32 34 36 38 40 42 44 46
FUNCTION
LOCK UPPER WIRE GUIDES 364 (CYLINDERS 372, 373)
IN
OUT
MOVE LOWER WIRE GUIDES 428 (CYLINDER 470)
FWD
BACK
ROTATE BOBBIN LOADING MECH. 46 (AIR MOTOR 102)
ADVANCE BOBBIN EJECTOR ROD 168 (CYLINDER 206)
ADVANCE BOBBIN TRANSFER MECH. 88, 106 (CYLINDER 118)
UNLOCK WINDING ARBOR MOTOR 180 (CYLINDER 186)
ROTATE WINDING ARBORS 154 (MOTOR 180)
UNLOCK X-AXIS SLIDE 300 (CYLINDER 340)
MOVE X-AXIS SLIDE 300 (MOTOR 334)
FWD
BACK
CLOSE LOWER WIRE GUIDES 428 (CYLINDER 228)
LEGEND
1. WHEN TAPE IS APPLIED TO WINDING.
2. IF REQUIRED WHEN TAPE IS NOT APPLIED TO WINDING.
(IF REQUIRED)
180° (IF REQUIRED)
WIND
(IF REQUIRED)
(180° (IF REQUIRED)
1
2
180°
INT. PT. TERMINALS
FLANGE
LAY WIRE
OUTER TERM.
INT. PT.
ANCHOR PINS
INT. PT.

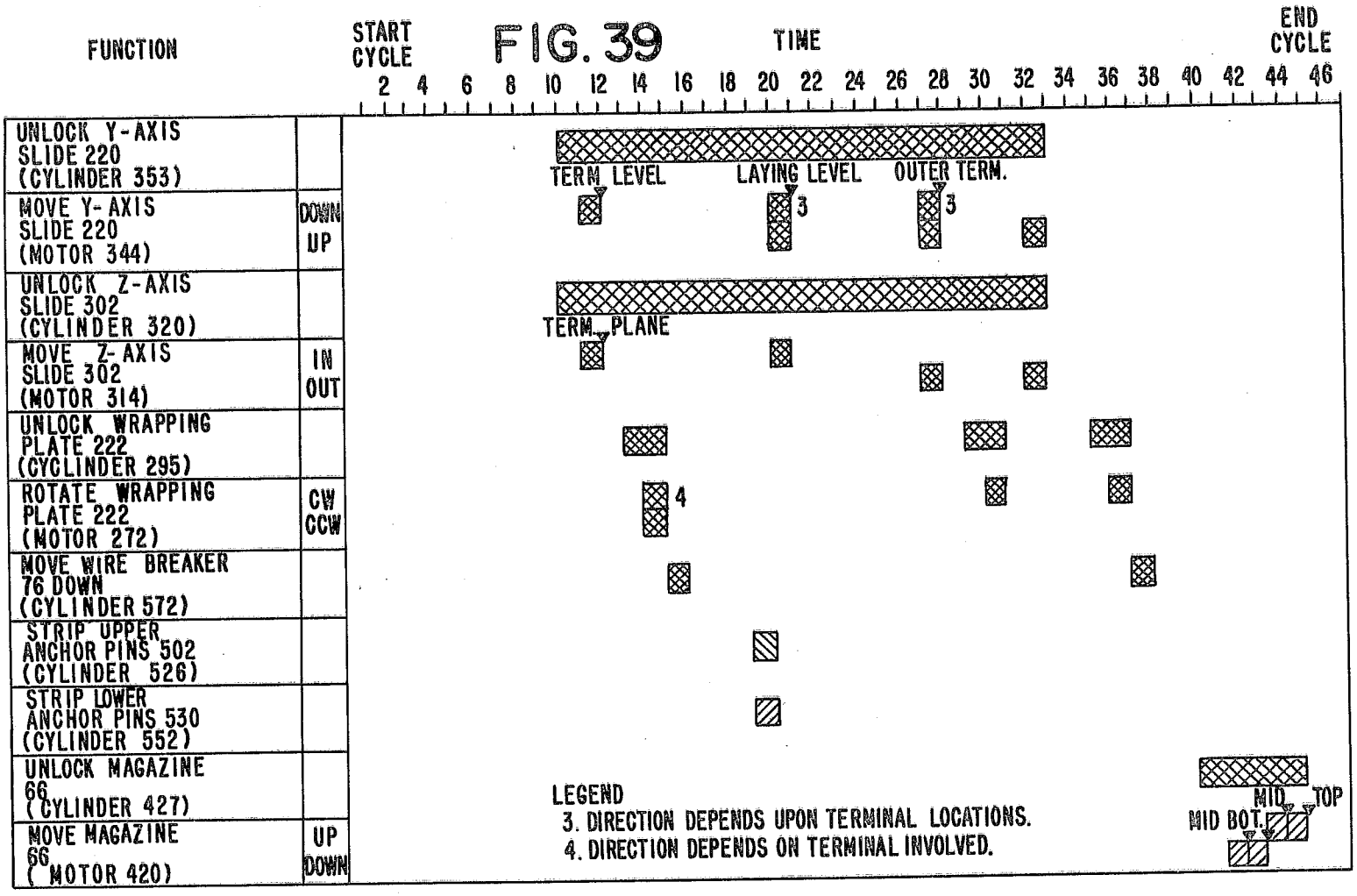
FIG. 39
FUNCTION
START CYCLE
TIME
END CYCLE
2 4 6 8 10 12 14 16 18 20 22 24 26 28 30 32 34 36 38 40 42 44 46
UNLOCK Y-AXIS SLIDE 220 (CYLINDER 353)
MOVE Y-AXIS SLIDE 220 (MOTOR 344)
DOWN UP
UNLOCK Z-AXIS SLIDE 302 (CYLINDER 320)
MOVE Z-AXIS SLIDE 302 (MOTOR 314)
IN OUT
UNLOCK WRAPPING PLATE 222 (CYCLINDER 295)
ROTATE WRAPPING PLATE 222 (MOTOR 272)
CW CCW
MOVE WIRE BREAKER 76 DOWN (CYLINDER 572)
STRIP UPPER ANCHOR PINS 502 (CYLINDER 526)
STRIP LOWER ANCHOR PINS 530 (CYLINDER 552)
UNLOCK MAGAZINE 66 (CYLINDER 427)
MOVE MAGAZINE 66 (MOTOR 420)
UP DOWN
TERM LEVEL
LAYING LEVEL
OUTER TERM.
TERM. PLANE
3
3
3
4
LEGEND
3. DIRECTION DEPENDS UPON TERMINAL LOCATIONS.
4. DIRECTION DEPENDS ON TERMINAL INVOLVED.
MID
TOP
MID BOT.

SELECTIVELY WINDING STRANDS ON A SUPPORT MEMBER

TECHNICAL FIELD

This invention relates to the selective winding of strands on a support member, and more specifically to the selective winding of wires on a bobbin either singly or in parallel with one another.

BACKGROUND OF THE INVENTION

The N. F. Smith et al. U.S. Pat. No. 3,713,599 discloses apparatus for winding wires on respective bobbins to produce a plurality of coils on each bobbin, and for applying insulating tape about each of the coils. In operation, each wire is initially wrapped on an anchor pin and then wrapped on a first terminal of a bobbin. A length of the wire then is wound on the bobbin to form a coil, the wire is wrap-terminated on a second terminal of the bobbin and the coil is covered with insulating tape wound about the coil. The wire then is wrapped on a third terminal of the bobbin, another length of the wire is wound on the bobbin to form another coil, the wire is wrap-terminated on a fourth terminal of the bobbin, and the second coil is covered with insulating tape. This procedure is continued until the desired number of coils and layers of insulating tape have been formed on the bobbin. After the wire has been wrap-terminated on on a last bobbin-terminal, this wire is again wrapped on the anchor pin.

In the Smith patent, after winding and taping of each bobbin has been completed, portions of the wire extending between the terminals on the bobbin are severed in a separate operation. During the course of the winding operation, the wires also are cut between the terminals and the anchor pins, whereupon the wrapped wire portions on the anchor pins are stripped therefrom. In the alternative, for thin wire gauges the wire portions between the bobbin terminals and the anchor pins may be severed by breaking the wire portions in tension as rotation of the bobbins is initiated at the beginning of a wire winding or coil taping operation. In either instance the severing of the wire portions between the bobbin terminals and the anchor pins leaves short wire segments extending from the bobbin terminals which also must be removed in a separate operation.

The J. S. Cartwright et al. U.S. Pat. No. 3,314,452 discloses methods of apparatus for winding wires on bobbins in which each wire initially is wrapped on an anchor pin, then wrapped upon a pin projecting from a winding arbor, and then guided through a first slot in a flange of bobbin to a hub of the bobbin. As rotation of the bobbin is initiated to wind wire on the hub of the bobbin to form a coil, the wire breaks between the anchor pin and the arbor pin in tension. After a length of the wire has been wound on the hub of the bobbin to form the coil, the coil is covered with insulating tape. The wire then is guided into a second slot in the bobbin flange and again wrapped on the anchor pin, whereupon a cutter mechanism is operated to sever the wire between the anchor pin and the bobbin. This procedure then is repeated until the desired number of taped coil windings have been provided on the bobbin.

In each of the above-described apparatus, when it is necessary to change the gauge of the wire to be wound on a bobbin, it is necessary to stop the apparatus, replace the wire supplies in the apparatus with new wire supplies of the desired wire gauge, and rethread the new wires through the apparatus. Further, each of the apparatus is capable of winding only one wire at a time on a bobbin. Thus, neither of the apparatus is particularly adapted for the manufacture of articles of a type in which coils of different wire gauges are required on a bobbin, or in which a pair of wires is to be wound on the bobbin in parallel to form a coil, as is the case with certain transformers and inductors presently utilized in telephone transmission equipment. Further, neither apparatus is particularly adapted for the manufacture of wound product in small lots in which it is necessary to change the wire gauge utilized in the apparatus from one lot to another on a frequent basis.

Accordingly, a purpose of this invention is to provide a new and improved apparatus for manufacturing articles such as wound transformers and/or inductors in which any one of a plurality of wires of different gauges readily can be wound upon a bobbin, or in which a first wire of one gauge and any of a plurality of other wires of the same or a different gauge can be wound upon the bobbin in parallel simultaneously.

SUMMARY OF THE INVENTION

The subject invention relates to the selective winding of a plurality of strands on a support member wherein each of the strands travels through a guide as the strand is wound on the support member. The guide for each strand is selectively mountable on a means for moving the guide to locate it in a winding position for winding of its respective strand on the support member. Winding of one of the strands which has been located in a winding position by its strand guide is accomplished by rotating the support member upon which the strand is to be wound. When the strand guides are not mounted on the strand guide moving means they are stored in a storage means, with the strand guides being selective transferable between the storage means and the strand guide moving means.

More specifically, apparatus for selectively winding a plurality of wires on bobbins in which the bobbin include terminals in spaced relationship, includes a bobbin loading mechanism and separate anchor means for anchoring portions of the wires against movement. Each wire travels through a wire guide from a supply of the wire as the wire guide is moved relative to its anchor means and as the wire is wound on one of the bobbins. An orbiting means having an adjustable wrap radius is mounted on a slide assembly and is movable in an orbital path for wrapping the wires on the anchor means and on the terminals of the bobbins. In conjunction with the wrapping of the wires on the anchor means and the terminals at the beginning and end of a bobbin winding cycle, a wire breaker means is operated to sever the wire closely adjacent the bobbin terminals without leaving any excess wire segments extending from the terminals. Resulting scrap wire portions on the anchor means then are stripped therefrom by operation of a wire stripper means.

Further, in connection with the wrapping of the wires on the bobbin terminals and the first and second anchor means, first support means for one of the wire guides is transferable from a respective storage means by a respective transfer means to the orbiting means into a fixed position, and a second support means for another of the wire guides is slidably mounted on the orbiting means for movement relative to the first wire guide support means when the first wire guide support means is mounted on the orbiting means. Thus, the second wire guide support means is movable relative to the first wire guide support means to locate the wire guides which are on the two support means in a closely spaced relationship corresponding to the spaced relationship of the terminals on the bobbins, for wrapping wires on two of the terminals simultaneously as the orbiting means is moved in its orbital path. The second wire guide support means also is movable relative to the first wire guide support means to locate the wire guides on the two support means in a remotely spaced relationship corresponding to a spaced relationship of the first and second anchor means, for wrapping wires on the first and second anchor means simultaneously as the orbiting means is moved in its orbital path.

In addition, a means for selecting one of the wires which is to be wound on a bobbin includes a first slide means mounted for reciprocable movement in a first direction. A plurality of second slide means, for storing the wire guides when they are not mounted on their respective support means on the orbiting means, are mounted on the first slide means for reciprocable movement in a second direction perpendicular to the first direction. The first slide means is movable into any one of a plurality of positions to locate one of the second slide means in position for transfer of the wire guide on the second slide means to the second wire guide support means, whereupon the second slide means in the transfer position is moved toward the second wire guide support means to transfer the wire guide thereto. During this transfer operation, the other second slide means are precluded against movement with the second slide means which is in the transfer position. Each of the second slide means also carries the second anchor means for its respective wire.

BRIEF DESCRIPTION OF THE DRAWINGS

FIG. 12 is a cross-sectional view of an eccentric cam shaft assembly taken along the line 12—12 in FIG. 10;

FIG. 13 is a cross-sectional view of the eccentric cam shaft assembly taken along the line 13—13 in FIG. 12;

FIG. 16 is an enlarged front elevational view of a portion of a wire guide storage magazine assembly of the apparatus;

FIg. 17 is a cross-sectional view taken along the line 17—17 in FIG. 16;

FIG. 18 is a cross-sectional view taken along the line 18—18 in FIG. 16;

FIG. 19 is an enlarged plan view of a portion of the apparatus as seen along the line 19—19 in FIG. 16, in a first operating condition;

FIG. 20 is a cross-sectional view taken along the line 20—20 in FIG. 19;

FIG. 21 is a cross-sectional view similar to FIG. 20 showing the portion of the apparatus in FIGS. 19 and 20 in a second operating condition;

FIG. 22 is an enlarged view of an anchor pin-and-stripper mechanism of the apparatus in a retracted condition;

FIG. 23 is a view similar to FIG. 22 showing the anchor pin-and-stripper mechanism in an advanced wire stripping condition;

FIGS. 24–36 are schematic views illustrating an operating sequence for the apparatus of the invention;

FIGS. 38 and 39 are a timing chart for the apparatus of the invention.

DETAILED DESCRIPTION

General

Figure 40:
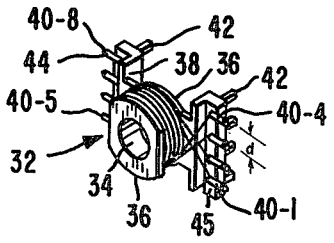
FIG. 40 is an isometric view of a wound bobbin which may be manufactured by the apparatus of the invention.
Figure 2:
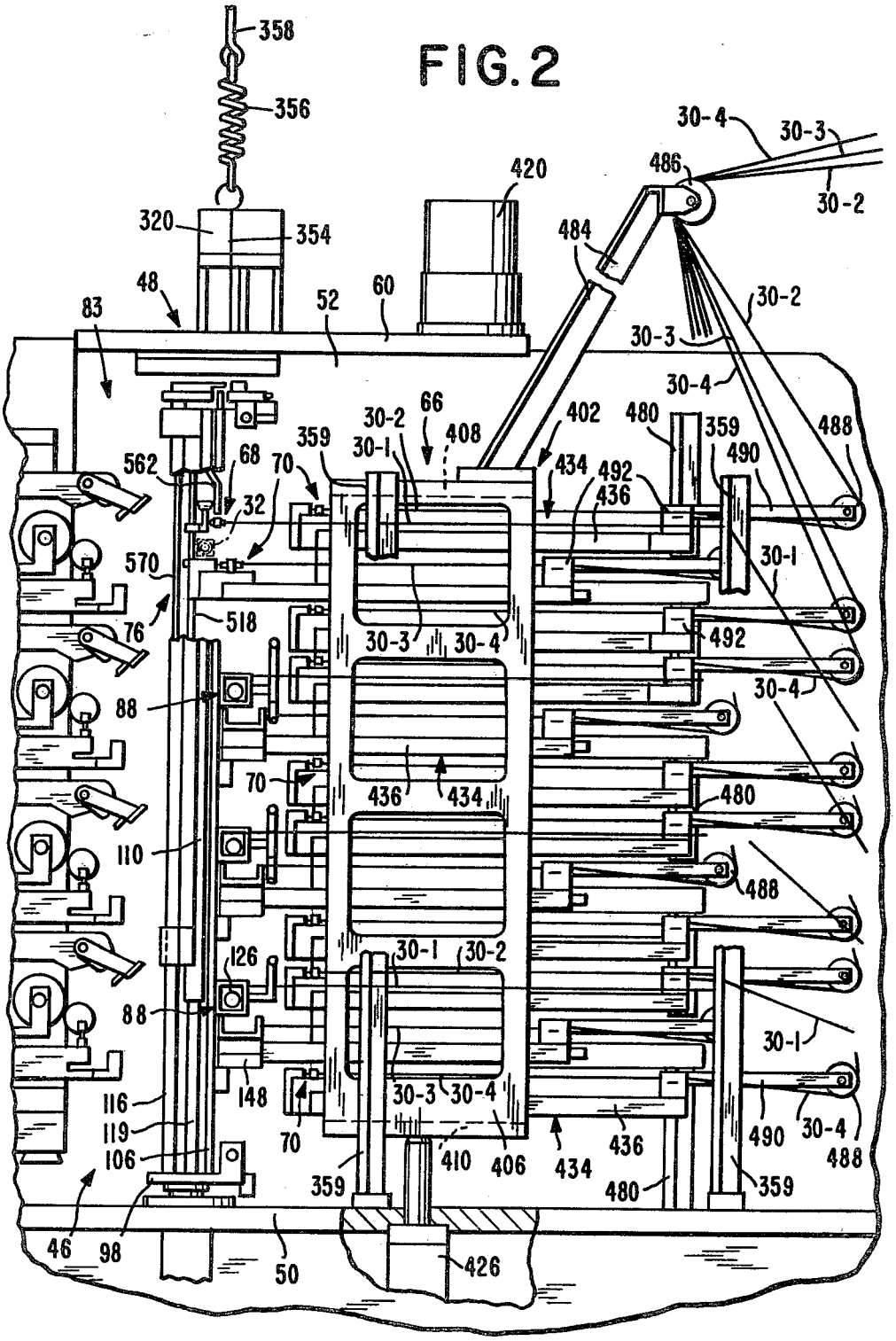
FIG. 2 is a front elevational view of the apparatus, with portions broken away.

In general, referring to FIGS. 2 and 40, the disclosed embodiment of the invention is directed to apparatus for selectively winding any one of a plurality of strands, such as four insulated wires 30-1, 30-2, 30-3 and 30-4 (FIG. 2), on a support member, such as a plastic bobbin 32. The apparatus also is capable of winding the first wire 30-1 and a selected one of the additional three wires 30-2, 30-3 or 30-4 on the bobbin 32 in parallel simultaneously. Further, the disclosed apparatus includes four sets of associated operating mechanisms so as to be capable of processing four sets of the wires 30 and winding four of the bobbins 32 simultaneously. In this connection, it is apparent that apparatus employing the principles of the invention may be constructed to wind fewer or more of the bobbins 32 simultaneously, as desired. Further, it is apparent that apparatus employing the principles of the invention may be constructed to process fewer or more of the wires 30, as desired.

As is best shown in FIG. 40, each of the bobbins 32 includes a central hub 34 having a pair of opposed flanges 36 at its opposite ends. One of the flanges 36 is formed integrally with a pair of terminal support bars 38 located at opposite ends of the flange. A plurality of terminals 40 of right angle construction have first legs 42 which are mounted in apertures in the support bars 38 and which project from the support bars for mounting of the wound bobbin 32 on a substrate, such as a printed circuit board (not shown). The terminals 40 also include second legs 44 spaced apart a preselected distance "d" and upon which the wires 30 which are being wound on the bobbin 32 are wrap-terminated during the winding operation, as shown in FIG. 40. Subsequently, the wrapped terminations of the wires 30 may be soldered to the second legs 44 of the terminals 40 in a known manner. One of the terminal support bars 38 also includes a projecting tab 45 at one end for orienting purposes.

Referring to FIGS. 1, 4, 5 and 6, at the start of a bobbin winding operation four of the empty bobbins 32 are manually positioned in a rotatable bobbin loading mechanism 46 at the front of the apparatus. Subsequently, the bobbin loading mechanism 46 rotates through 180° and transfers the empty bobbins 32 to a bobbin rotating mechanism 47 (FIGS. 1 and 7) for the winding operation.

Figure 1:
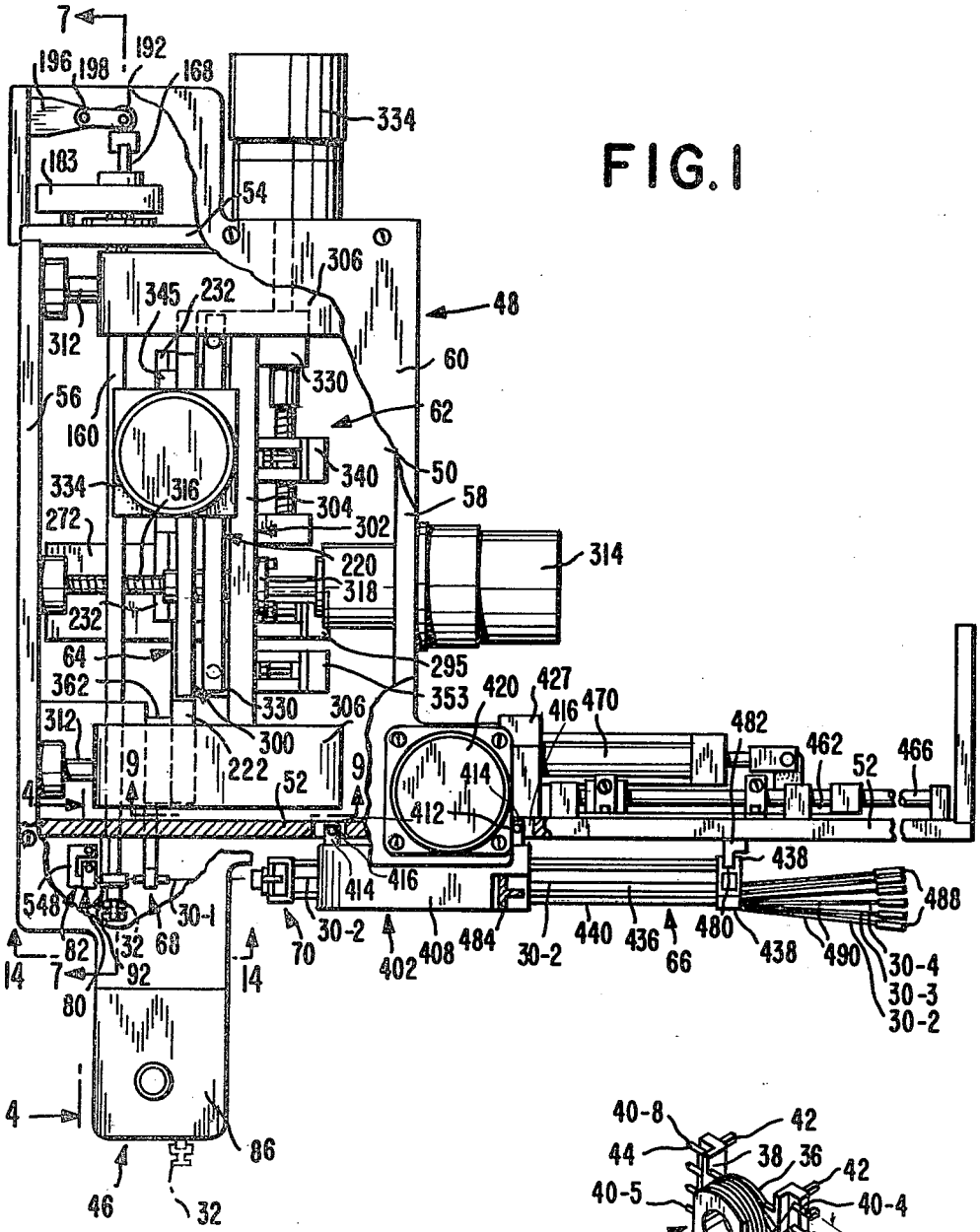
FIG. 1 is a plan view of an apparatus in accordance with the invention, with portions broken away.
Figure 3:
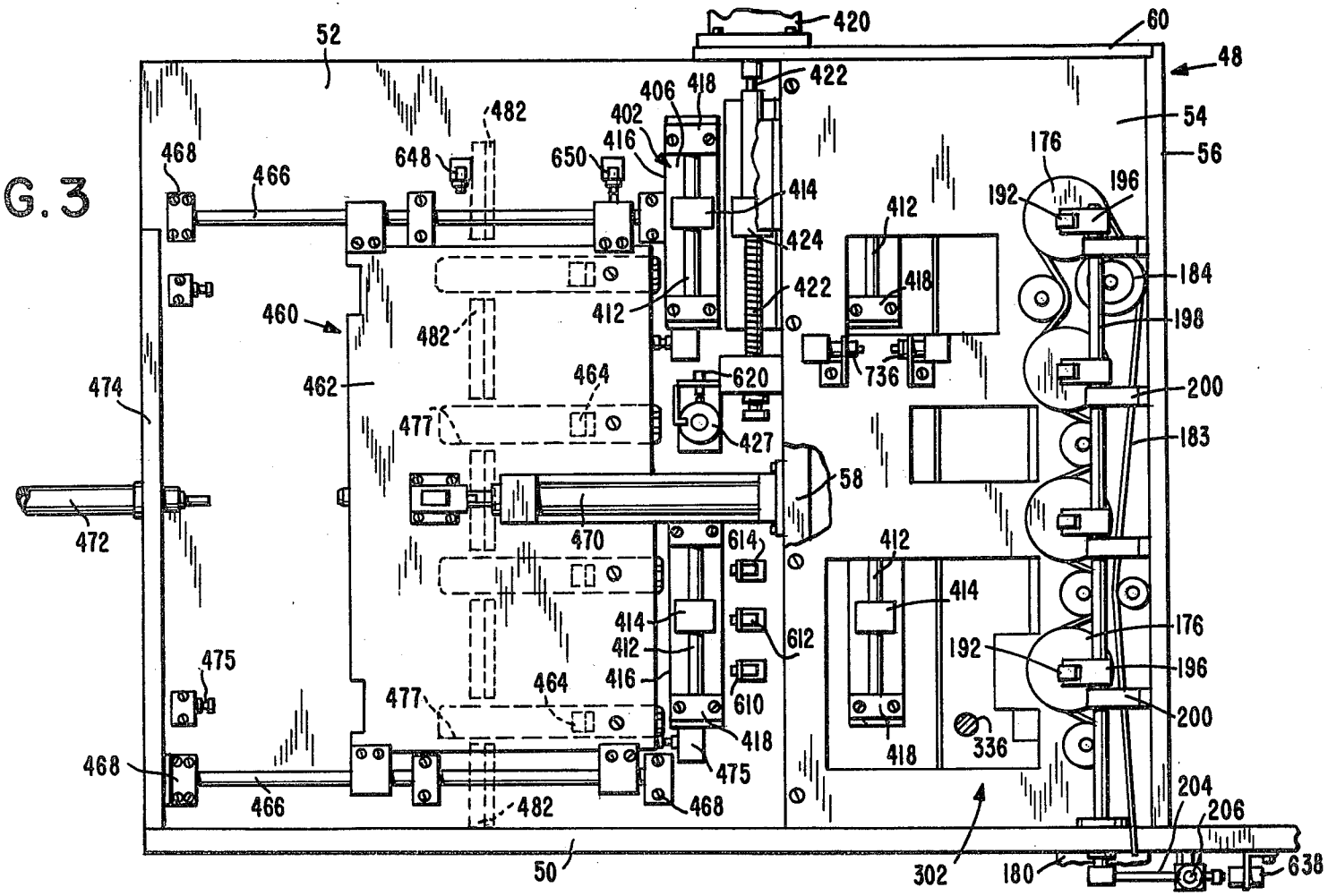
FIG. 3 is a rear elevational view of the apparatus.

Referring to FIGS. 1, 2 and 3, the bobbin rotating mechanism 47 is supported, in part, in a housing 48 defined by a horizontally disposed main support table 50, a vertically disposed front mounting plate 52, a vertically disposed rear mounting plate 54, a pair of horizontally spaced, vertically disposed side mounting plates 56 and 58, and a top cover mounting plate 60. The front, rear and side mounting plates 54, 56 and 58 are suitably secured at their lower edges to the main support table 50 and at their upper edges to the top cover mounting plate 60. An X, Y, Z wire guide positioning carriage assembly 62 (shown in detail in FIGS. 8–11), having an orbital wire wrapping plate assembly 64 (best shown in FIGS. 8–13) mounted thereon, also is mounted in the housing 48. In addition, the front mounting plate 52 supports a wire guide storage magazine assembly 66 (shown in detail in FIGS. 16–23).

The winding of one or more of the wires 30 on each of the bobbins 32 from respective wire supplies (not shown) is accomplished by selective operation of upper needle wire guide assemblies 68 for respective ones of the first wires 30-1, and/or lower needle wire guide assemblies 70 for respective ones of the additional wires 30-2, 30-3 and 30-4. In this connection, the disclosed apparatus includes four of the upper needle wire guide assemblies 68, one for each of the first wires 30-1, and four sets of three of the lower needle wire guide assemblies 70, for respective ones of the additional wires 30-2, 30-3 and 30-4.

Figure 8:
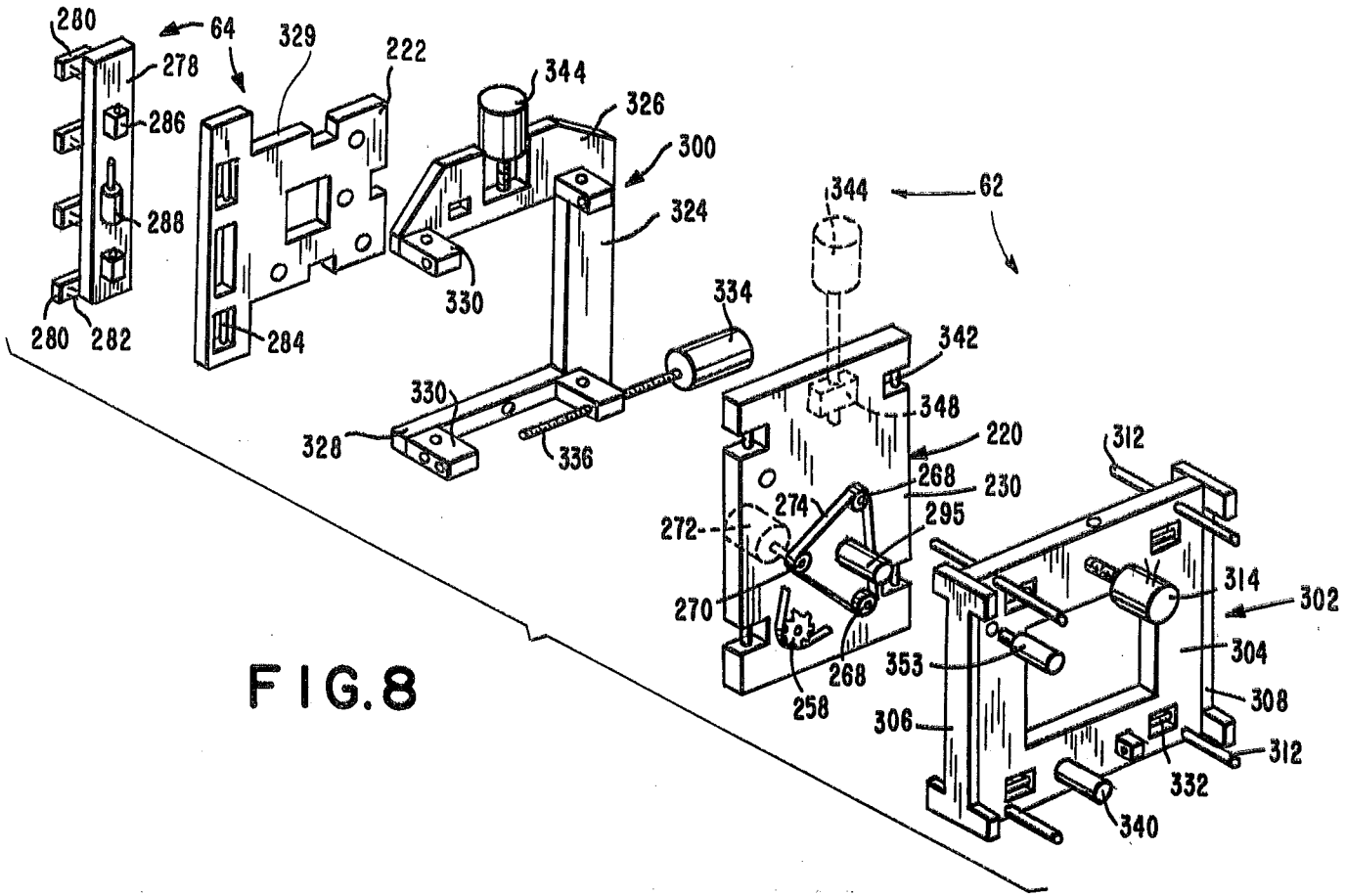
FIG. 8 is an isometric exploded view of an X, Y, Z carriage assembly and a wrapping plate assembly of the apparatus.
Figure 15:
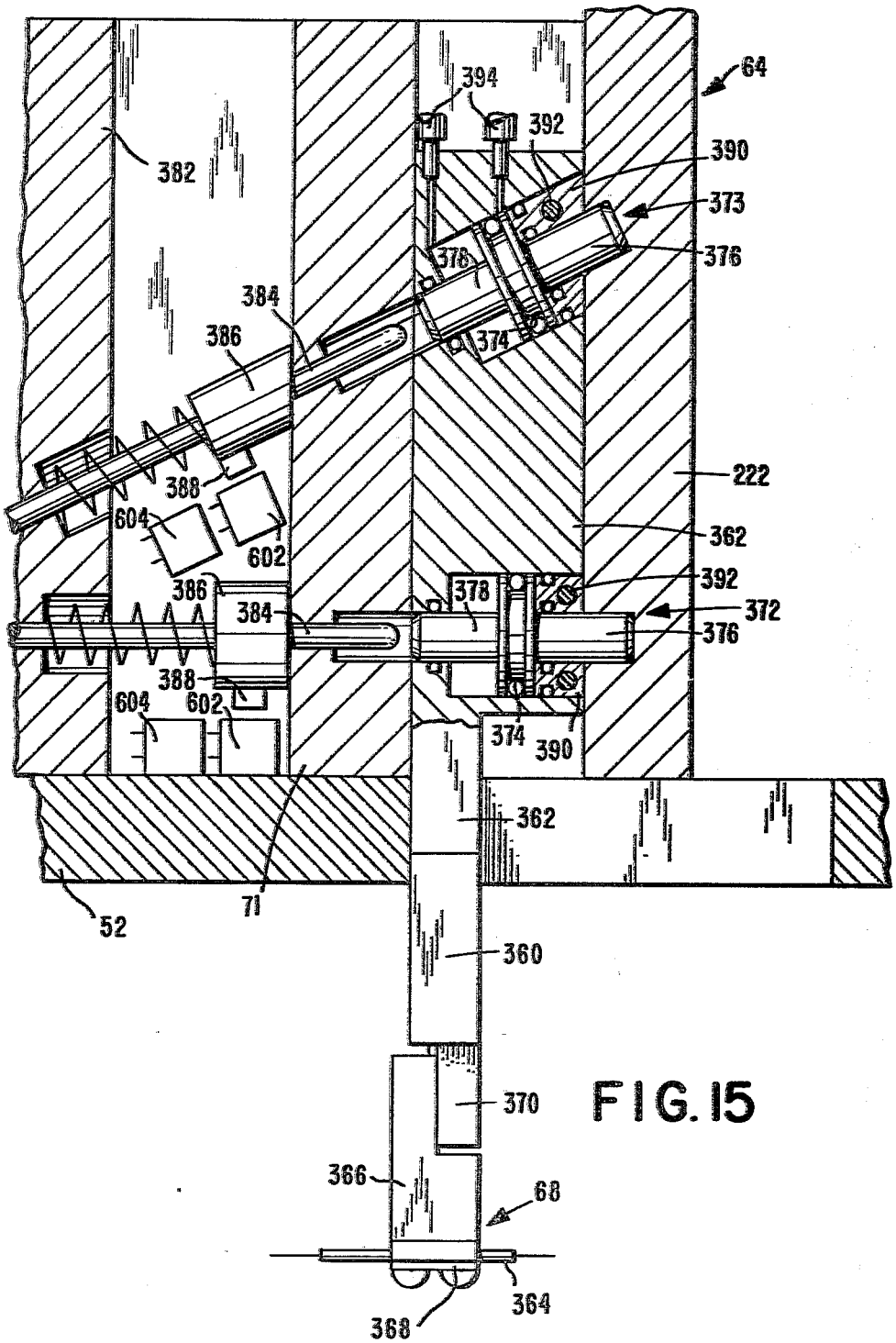
FIG. 15 is a cross-sectional view taken along the line 15—15 in FIG. 9.

Referring to FIG. 15, in the disclosed apparatus the upper needle wire guide assemblies 68 are normally locked in an operative position to the orbital wire wrapping plate assembly 64 on the X, Y, Z carriage assembly 62 (FIG. 8). However, the upper needle wire guide assemblies 68 may be released from the wire wrapping plate assembly 64 and locked to an adjacent support plate 71 of right-angle construction, in an inoperative position, if so desired. Further, it is apparent that the upper needle wire guide assemblies 68 may normally be stored on the support plate 71 and transferred to the wire wrapping plate assembly 64 for a bobbin winding operation, if so desired.

Similarly, referring to FIG. 2, the lower needle wire guide assemblies 70, when not in use, are stored in the magazine assembly 66 at the right-hand side of the apparatus, as viewed in FIG. 2. Then, when one of the lower wire guide assemblies 70 in each set of the lower wire guide assemblies is to be utilized in a bobbin winding operation, the selected wire guide assemblies are transferred to the wire wrapping plate assembly 64 for movement therewith.

In winding the first wires 30-1 on the bobbins 32, the wires initially are secured to respective upper anchor pins 72 (FIGS. 14 and 24), either by being manually wrapped thereon at the beginning of a first bobbin winding cycle, or as a result of having been automatically wrap-terminated thereon by the apparatus in a previous bobbin winding cycle. The apparatus then wraps the wires 30-1 on respective starting ones of the terminals 40 of the bobbin 32, breaks the wires between the wrapped terminals and the upper anchor pins 72, winds the wires on the central hubs 34 of the bobbins, wrap-terminates the wires on respective finishing ones of the bobbin terminals, again wrap-terminates the wires on the upper anchor pins, and again breaks the wires between the finishing bobbin terminals and the anchor pins, as illustrated in FIGS. 25–36.

Similarly, in winding selected ones of the additional wires 30-2, 30-3 or 30-4 on the bobbins 32, the wires initially are wrapped on lower anchor pins 74 (FIGS. 19, 22 and 24–31) which form parts of the lower needle wire guide storage magazine assembly 66 (FIG. 2). As in the case of the first wires 30-1, the apparatus then proceeds through terminal wrapping, bobbin winding and wire breaking steps with the wires 30-2, 30-3 or 30-4, completing the bobbin winding cycle by again wrap-terminating the wires on the lower anchor pins 74, as illustrated in FIGS. 32–36.

In conjunction with the wrapping of the wires 30 on the upper and lower anchor pins 72 and 74 and on the bobbin terminals 40 at the beginning and end of each bobbin winding cycle, the disclosed apparatus includes a wire breaker mechanism 76 (best shown in FIGS. 14, 32 and 33) which is operated to break off the wrapped wires closely adjacent the bobbin terminals without any excess wire segments extending from the terminals. The breaking of the wires 30 produces wire pigtails 78 (FIGS. 24–33) on the anchor pins 72 and/or 74, which are ejected from the anchor pins by the operation of associated first and second wire stripper mechanisms 80 and 82 (FIG. 14), respectively, as illustrated in FIG. 33 for the lower anchor pins 74. Lengths of insulating tape (not shown) also may be wrapped about the windings on the bobbins 32 as desired, utilizing taping mechanisms 83 (FIG. 2) of the type disclosed in U.S. Pat. No. 4,148,677, issued Apr. 10, 1979 to W. G. Bellamy et al., the disclosure of which is incorporated herein by reference.

Bobbin Loading Mechanism

Figure 4:
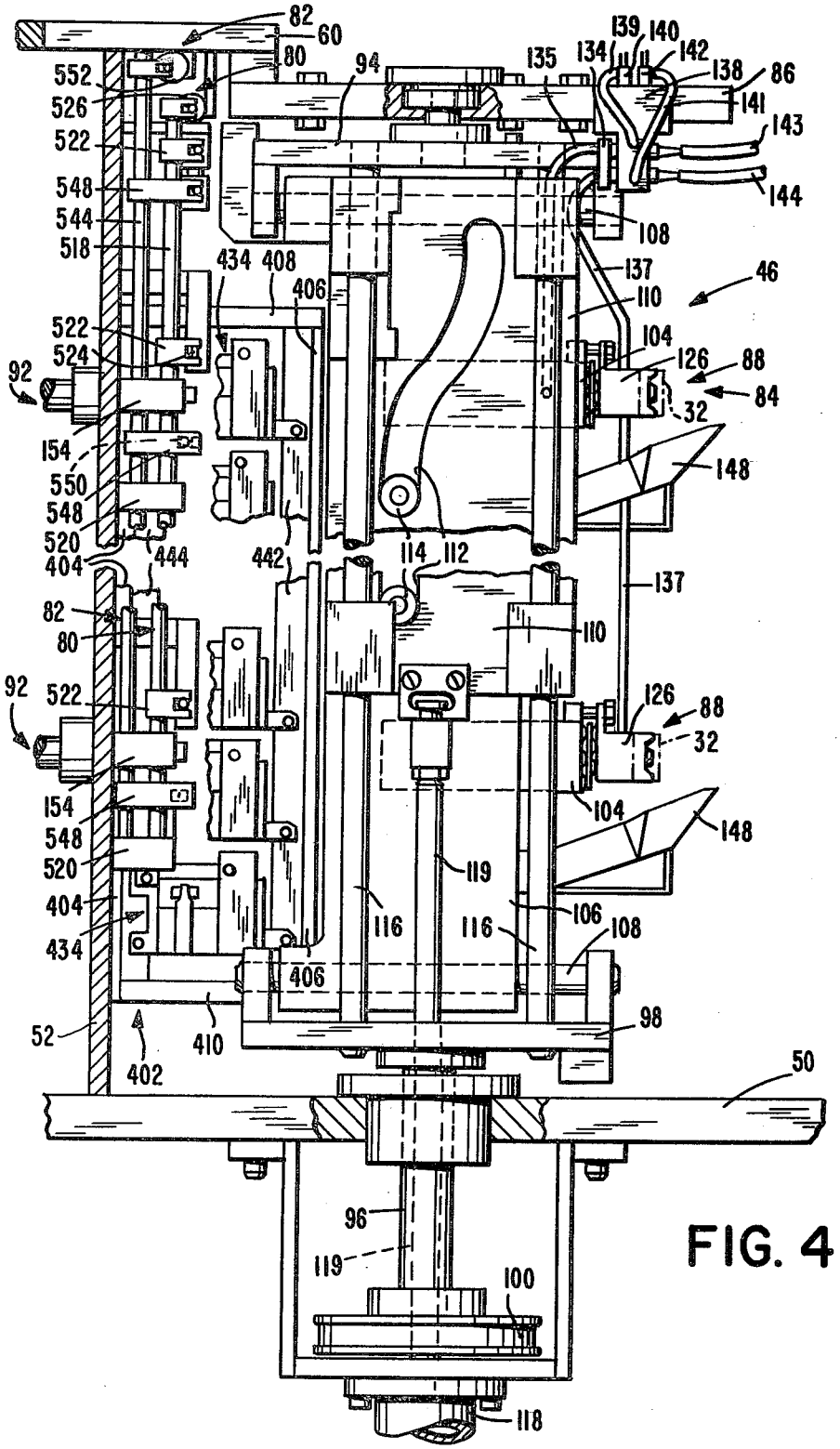
FIG. 4 is an enlarged cross-sectional view of the apparatus taken along the line 4—4 in FIG. 1.
Figure 5:
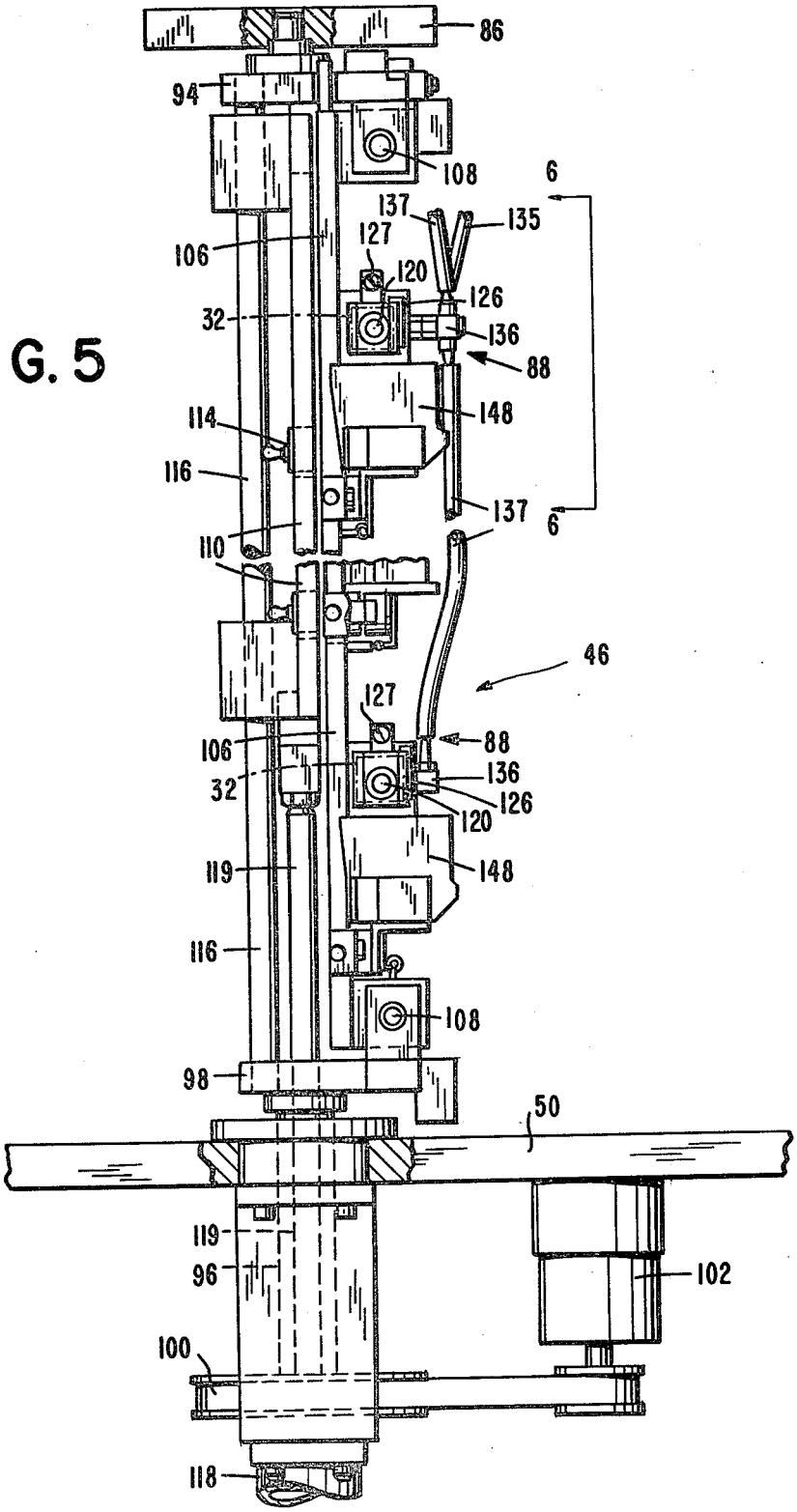
FIG. 5 is a partial front elevational view of a bobbin loading mechanism of the apparatus.

As is best shown in FIGS. 4 and 5, the bobbin loading mechanism 46 includes a turret 84 which is mounted for rotation about a vertical axis at its upper end in a cantilevered plate member 86 mounted on the top cover mounting plate 60 (shown only in FIG. 4), and at its lower end in the main support table 50 of the apparatus. Vertically spaced, horizontally disposed loading plunger assemblies 88 are mounted on the turret 84 for rotation therewith through an arc of 180° between positions as shown in solid lines in FIG. 4, in which the bobbins 32 can be manually positioned on the assemblies at their right-hand ends as viewed in this figure, and positions in which the bobbins are automatically transferred from the loading plunger assemblies to winding arbor assemblies 92 of the bobbin rotating mechanism 47.

The turret 84 includes an upper mounting plate 94 having a vertically projecting stub shaft secured thereto and suitably journaled for rotation in the cantilevered plate 86. Similarly, a vertically extending hollow drive shaft 96 is suitably secured at an upper end thereof to a lower mounting plate 98 of the turret and projects downward through the main support table 50, in which it is suitably journaled for rotation. The lower end of the vertical hollow shaft 96 has a drive pulley 100 secured thereon and the drive pulley is connected by a belt drive to an air-powered reversible rotary actuator 102 (FIG. 5) mounted beneath the main support table 50 for rotating the turret 84 between its bobbin-receiving and bobbin-transfer position. For example, the rotary actuator 102 may be the model #R1A-3360-P-D available from PHD, Incorporated of Fort Wayne, Ind.

Each loading plunger assembly 88 includes a hollow horizontally extending support block 104 (FIGS. 4 and 6) mounted on a vertically disposed, horizontally movable slide plate 106 of the turret 84. At its upper and lower ends the slide plate 106 is slidably mounted on horizontal guide shafts 108 (FIGS. 4 and 5) fixed at their opposite ends in projecting lugs on the upper and lower mounting plates 94 and 98.

Referring to FIGS. 4 and 5, after the turret 84 has been rotated for a bobbin loading operation, the vertically disposed slide plate 106 is movable from a retracted position to an advanced position to transfer the bobbins 32 from the loading plunger assemblies 88 onto the winding arbor assemblies 92 (FIG. 4), by a vertically movable camming plate 110. The camming plate 110 includes vertically spaced cam tracks 112 which receive respective cam rollers 114 mounted on the vertically disposed slide plate 106. The camming plate 110 is mounted for vertical movement on vertical guide rods 116 extending between the upper and lower mounting plates 94 and 98. An air cylinder 118 is mounted beneath the main support table 50 on a bracket suspended beneath the table, with a piston rod 119 of the air cylinder extending upward through the hollow drive shaft 96 and connected at an upper end to the camming plate 110.

Figure 6:
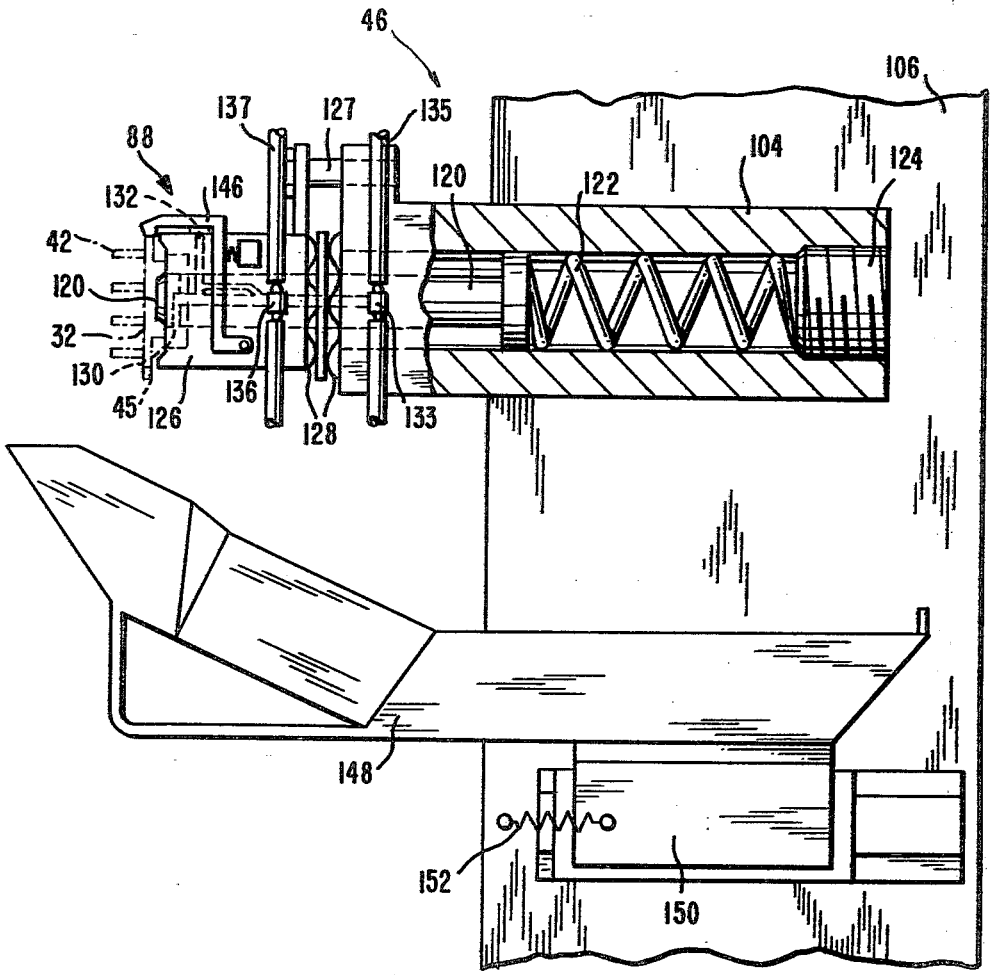
FIG. 6 is a partial side elevational view of the bobbin loading mechanism as seen along the line 6—6 in FIG. 5.

Referring to FIG. 6, each of the loading plunger assemblies 88 includes a plunger 120 reciprocably mounted in the support block 104 of the assembly and biased to an advanced position by a coil spring 122, with the plunger and the coil spring being retained in the block by a screw threaded plug 124 in one end of the block. A bobbin-receiving plastic nest member 126 is resiliently mounted, by means of a screw 127 and spring washers 128, on the other end of the support block 104 with the plunger 120 extending through the nest member and projecting into a bobbin-receiving recess therein for the reception of one of the bobbins 32 on the plunger.

Each plunger 120 includes an air hole 130 for sensing the presence of one of the bobbins 32 on the plunger and each bobbin-receiving nest member 126 includes an air hole 132 for sensing the orientation of one of the bobbins on the plunger. The sensor hole 130 in the plunger 120 is connected by a suitable passageway in the plunger to an air line fitting 133 in the plunger's support block 104. The air line fittings 133 are interconnected to each other, and the uppermost fitting is connected to a first air manifold 134 (FIG. 4) mounted on the turret upper mounting plate 94, by suitable air lines 135. Similarly, the sensor hole 132 in the bobbin nest member 126 is connected by a suitable passageway in the nest member to an air line fitting 136 mounted on the nest member. As in the case of the air line fitting 133 for detecting bobbin presence, the air line fittings 136 on the nest members 126 are connected to each other and the air manifold block 134 by suitable air lines 137.

The first air manifold block 134 (FIG. 4) includes a pair of ports, one for each of the sets of the air lines 135 and 137 connected to the block, which mate with respective rubber bushings at a pair of ports of a second manifold block 138 mounted on one side of the cantilevered plate 86, when the turret 84 is in its bobbin-receiving position as shown in FIG. 4. At this time, the first air lines 135 for detecting bobbin presence are connected through the air manifold blocks 134 and 138, and an air line 139, to a first fluidic-sensitive electrical switch 140 mounted on the cantilevered plate 86. Similarly, the air lines 137 for detecting bobbin orientation are connected through the air manifold blocks 134 and 138, and an air line 141, to a second fluidic-sensitive electrical switch 142 on the cantilevered plate 86. Air is introduced into the second manifold block 138 for the air lines 135 and 137 through input air lines 143 and 144, respectively. When the first manifold block 134 rotates with the turret 84 for a bobbin transfer operation, air exhausts from the second manifold block 138 through the above-mentioned rubber bushings to the atmosphere.

The air hole sensor 132 (FIG. 6) in each of the nest members 126 normally is covered by a spring biased lever 146 pivoted at one end on the nest member. The other end of the lever 146 includes a finger portion which projects beyond the nest member 126 and which is engageable by the tab portion 45 (FIG. 40) of one of the bobbins 32 being positioned on the plunger 120, when the bobbin is in a properly oriented condition. Thus, when one of the bobbins 32 is positioned on the plunger 120, the bobbin covers the air hole 130 in the plunger creating a fluidic back pressure in the air lines 135 which operates the first fluidic-sensitive electrical switch 140 (FIG. 4). At the same time, if the bobbin 32 is properly oriented, the bobbin tab portion 45 will not engage and pivot the lever 146 to uncover the air hole 132 in the nest member 126, whereby the fluidic pressure in the air lines 137 does not change to operate the second fluidic-sensitive switch 142, and the apparatus is ready for operation.

A part-receiving tray 148 is mounted below each loading plunger assembly 88 on the turret slide plate 106 for horizontal movement with the slide plate and for sliding movement relative thereto, during a bobbin transfer operation. In this connection, the tray 148 is mounted on a horizontal secondary slide 150 mounted on the slide plate 106, and is biased to an advanced position by a coil spring 152 connected between the slide plate and the secondary slide.

To preclude operator injury, the front of the bobbin loading mechanism 46 preferably is protected by a safety device (not shown) which is capable of detecting presence of the operator's hand adjacent the bobbin loading mechanism 46, and rendering the loading mechanism inoperative until the hand is removed. For example, the safety device may be an infrared type which is responsive to the presence of an object, such as a human hand, sold by the Data Instruments Corporation of Lexington, Mass. under the Tradename "Shadow."

After the bobbins 32 have been properly positioned on the loading plungers 120 as above described, and upon removal of the operator's hand from the object-responsive area of the above-mentioned safety device (not shown), the rotary actuator 102 (FIG. 5) is energized to cause rotation of the turret 84 of the bobbin loading mechanism 46 through 180° against a first stop (not shown) on the main support table 50. As the turret 84 completes its 180° rotation, the bobbins 32 become aligned with respective winding arbors 154 (FIG. 4) of the bobbin rotating mechanism 47 for transfer to the winding arbors.

Following ejection of any wound bobbins 32 on the winding arbors 154 from a previous winding cycle into the part-receiving trays 148, the camming plate air cylinder 118 is operated to move the camming plate 110 downward, thereby camming the turret vertical slide plate 106 and the loading arbor assemblies 88 thereon horizontally to transfer the bobbins 32 from the loading arbor assemblies onto the winding arbors. During this transfer operation the winding arbors 154 engage and move the spring-biased loading plungers 120 to a retracted position relative to the bobbins 32 and the nest members 126, such that the bobbins become received on the winding arbors. The air cylinder 118 then is deactivated to move the camming plate 110 upward into its original position, thereby retracting the turret vertical slide plate 106 and the loading arbor assemblies 88, with the loading arbors 120 being returned to their initial positions by their respective biasing springs 122. The rotary actuator 102 for the turret 84 then is energized in a reverse direction to return the turret to its initial position against a second stop (not shown) on the main support table 50.

Bobbin Rotating Mechanism

Figure 7:
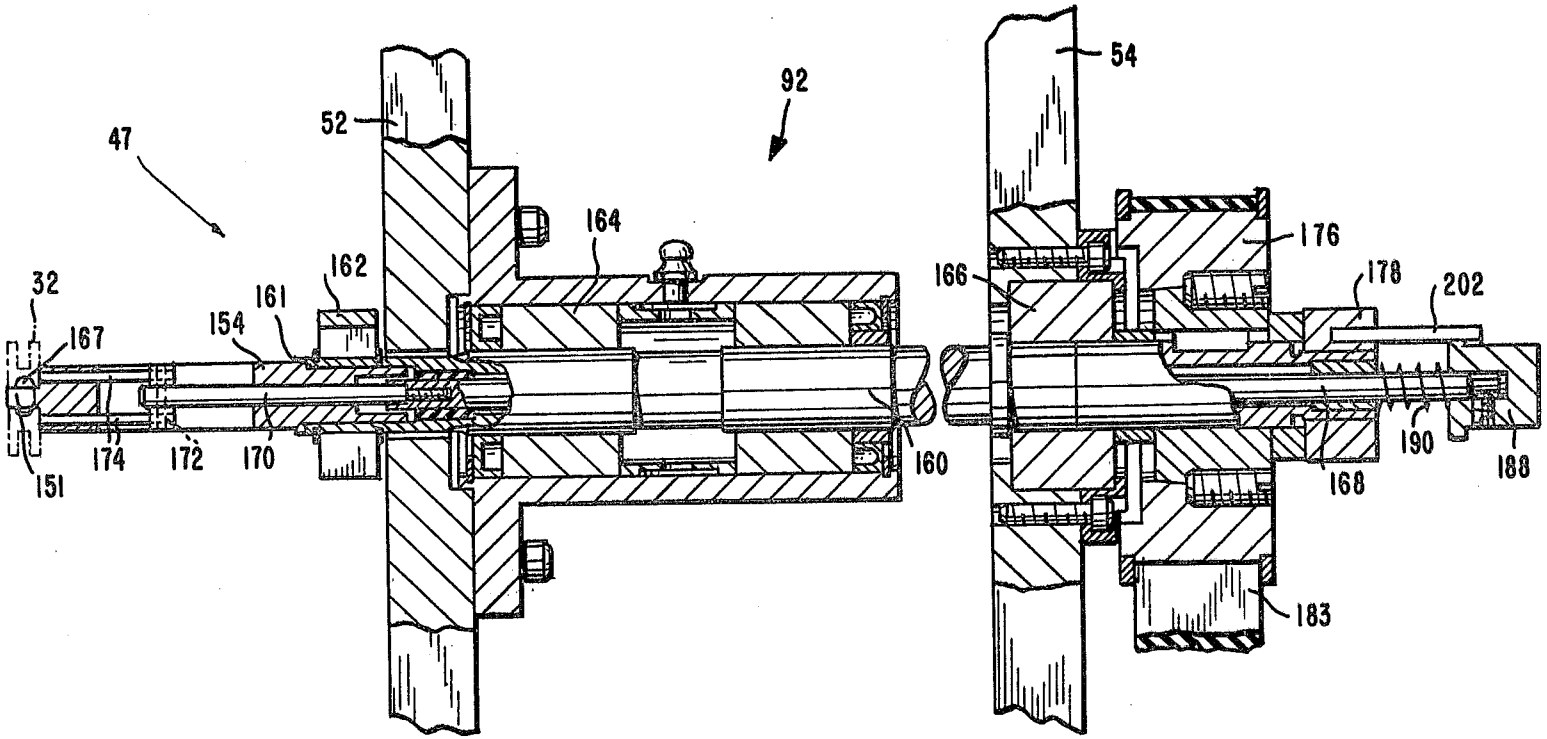
FIG. 7 is a partial cross-sectional view of a bobbin rotating mechanism of the apparatus taken along the line 7—7 in FIG. 1.

Referring to FIG. 7, each winding arbor assembly 92 includes a horizontal drive shaft 160 having a left-hand or front end sleeve portion 161 in which a reduced shaft extension of the winding arbor 154 of the assembly is removably mounted by a clamping collar 162. The drive shaft 160 is journaled in suitable bearings 164 and 166 in the vertically disposed front and rear mounting plates 52 and 54, respectively. The arbor 154 includes a front end portion 151 which is receivable in the center aperture in one of the bobbins 32 in conforming relationship and upon which the bobbin is held in a suitable manner, such as by spring-loaded ball detents 167. The arbor 154 is interchangeable with other arbors (not shown) having bobbin-carrying outer end portions 151 of different configurations for accommodating bobbins having center apertures of different sizes and shapes.

With further reference to FIG. 7, a bobbin ejector rod 168 is slidably mounted in the winding arbor drive shaft 160 for ejecting one of the bobbins 32 from the arbor 154 after the winding of the bobbin is completed. At its forward end the ejector rod 168 is screw threadably secured to an ejector extension rod 170 mounted in the arbor 154. The ejector extension rod 170 is secured by a dowel pin 172 to a pair of ejector pins 174 slidably mounted in the arbor 154. More specifically, the dowel pin 172 extends transversely through inner enlarged ends of the ejector pins 174 and a forward end of the ejector extension rod 170, and is received for reciprocal movement in an elongated slot in the arbor 154.

Figure 37:
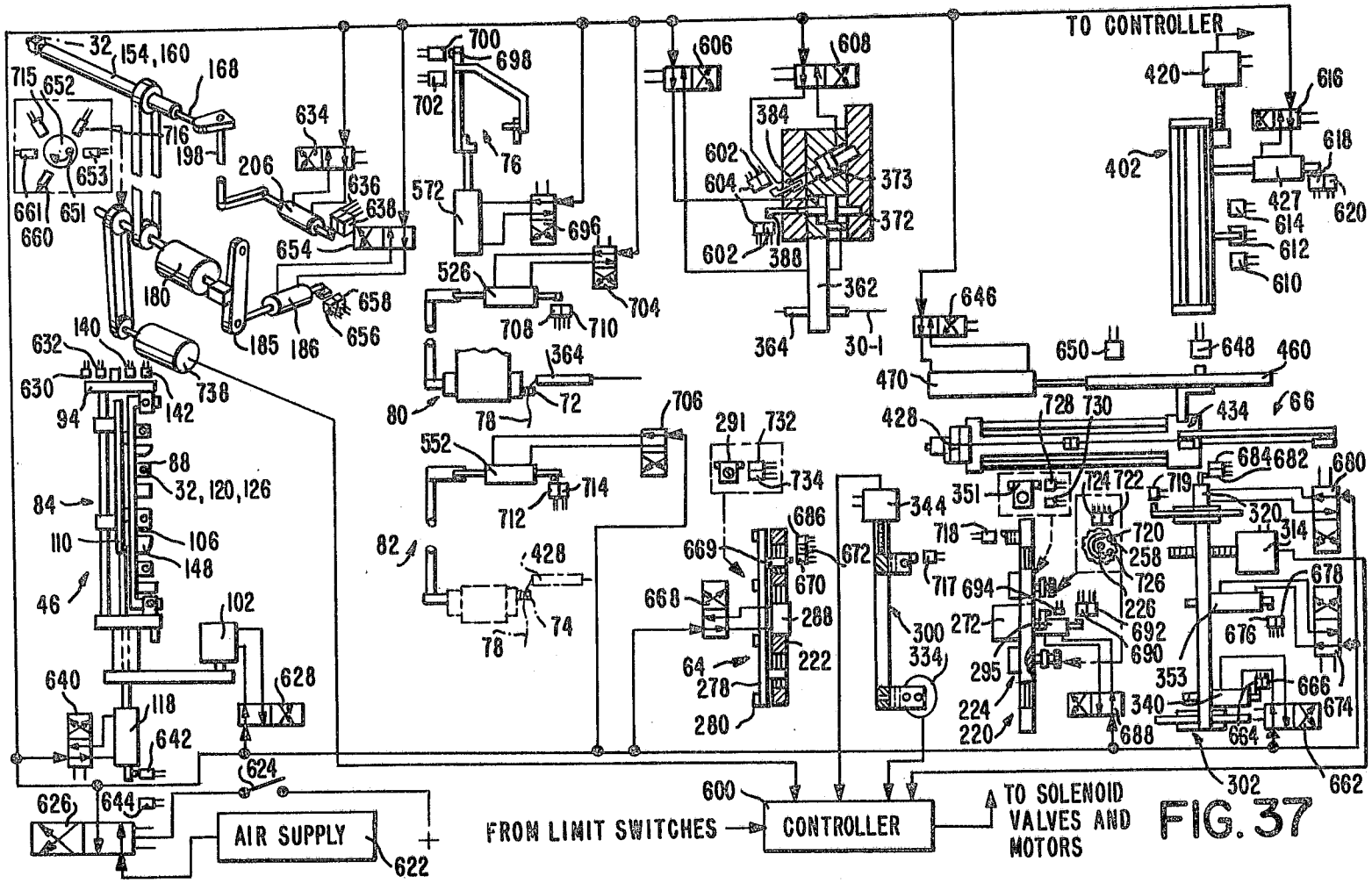
FIG. 37 is a schematic diagram of a control system for the apparatus of the invention.

Referring to the right-hand side of FIG. 7, a drive pulley 176 is mounted on the rearward end of each winding arbor drive shaft 160 and is retained on the drive shaft by a screw threaded nut member 178. Referring to FIG. 3, the drive pulleys 176 are connected to a drive pulley (FIG. 37) on the shaft of a drive motor 180 mounted beneath the horizontal main support table 50, by a belt 183 trained over suitable idler pulleys 184 mounted on the vertically extending rear mounting plate 54. As is best shown in FIG. 37, the shaft of the motor 180 includes a rearward extension having flat surfaces on opposite sides thereof selectively engageable by a pivoted locking bar 185 to lock the motor, and thus the winding arbors 154, in reference positions 180° apart. The locking bar 185 is operated to lock or unlock the shaft of the motor 180 by an air cylinder 186.

With further reference to the right-hand side of FIG. 7, a cap member 188 is suitably secured on the rearward end of each bobbin ejector rod 168, with the ejector rod, its extension rod 170, and the cap member, being biased to a retracted position by a coil spring 190. The cap member 188 also is engageable by a cam roller 192 (FIG. 3) rotatably supported on one end of an operating lever 196. The operating lever 196 is secured at its opposite end to a rotatable vertically extending actuating shaft 198 journaled in a bushing in the main support table 50 and in suitable brackets 200 mounted on the first vertical side mounting plate 56. The bobbin ejector rod 168 is retained against rotatable movement by a guide pin 202 (FIG. 7) which projects rearwardly from the drive pulley retaining nut member 178 into a slot in the adjacent cap member 188.

The actuating shaft 198 (FIG. 3) extends downwardly beneath the main support table 50 and is connected by an operating arm 204 to a piston rod of an air cylinder 206 mounted beneath the table. Operation of the air cylinder 206 causes rotation of the actuating shaft 198 to pivot the operating levers 196 and thus cause advancement of the bobbin ejector rod assemblies 168, 170 (FIG. 7) and the bobbin ejector pins 174 (FIG. 7) to eject wound bobbins 32 on the arbors 154 (FIG. 7) simultaneously into respective ones of the part-receiving trays 148 (FIG. 6) of the bobbin loading mechanism 46 after the trays have been rotated into bobbin-receiving positions with the turret 84 of the bobbin loading mechanism 46 as above described. Upon de-energization of the air cylinder 206 the bobbin ejector rod assemblies 168, 170 and the cap members 188 are returned to their initial positions by the coil springs 190 (FIG. 7).

Wire Wrapping Plate Assembly

Referring to FIGS. 8–13, the orbital wire wrapping plate asembly 64, to which the upper and lower needle wire guide assemblies 68 and 70 can be selectively transferred for a bobbin winding operation as noted hereinabove, is mounted on a Y-axis slide 220 of the X, Y, Z slide assembly 62 for eccentric rotary motion relative to the Y-axis slide. Thus, when the upper needle wire guide assemblies 68 and respective ones of the lower wire guide assemblies 70 are supported on the wire wrapping plate assembly 64, the wires 30 extending through the guide assemblies can be wrapped on the upper and lower anchor pins 72 and 74, and on the bobbin terminals 40, during a bobbin winding operation. In this connection, the Y-axis slide 220 is mounted, by means of the X, Y, Z slide assembly 62 of which it forms a part, for both horizontal and vertical movement for positioning of the upper and lower needle wire guide assemblies 68 and 70 adjacent the upper and lower anchor pins 72 and 74, respectively, and adjacent the bobbin terminals 40, for wrapping of the wires 30 thereon and for positioning the needle wire guide assemblies opposite the bobbins 32 for winding of the wires on the bobbins.

The wrapping plate assembly 64 includes a vertically disposed wrapping plate 222 which is mounted on the vertically disposed Y-axis slide 220 for orbital motion by a plurality of eccentric cam assemblies 224 (FIGS.

10–13) of essentially identical construction. The eccentric cam assemblies 224 are rotatably adjustable to vary the amount (i.e., radius) of orbital movement imparted to the wrapping plate 222 in accordance with the spacing "d" (FIG. 40) between the bobbin terminals 40. By way of example, the amount of orbital movement of the wrapping plate 222 may be adjusted between an orbital movment having a radius of 0.100 inches and an orbital movement having a radius of 0.075 inches.

Figure 10:
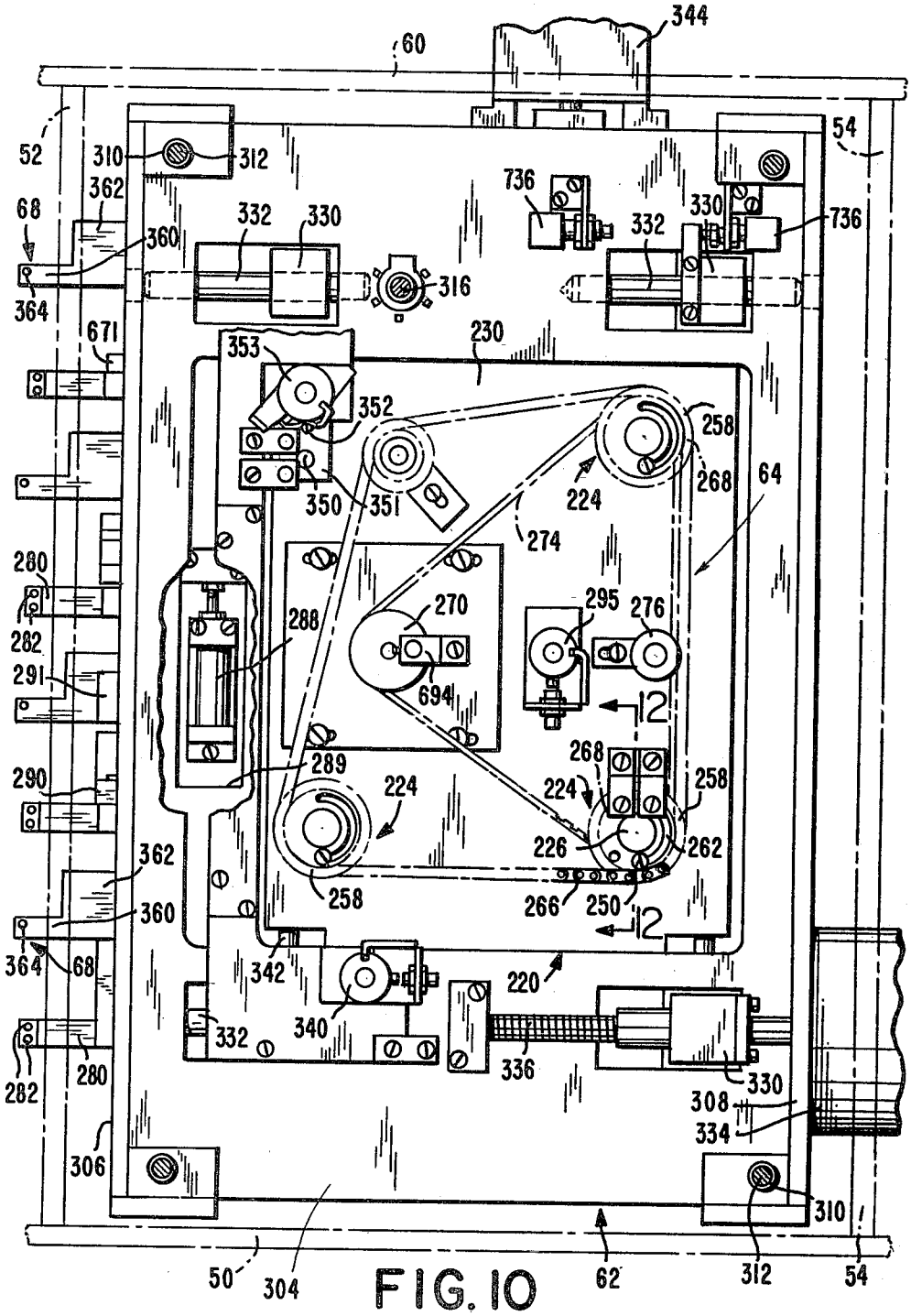
FIG. 10 is a side elevational view of the apparatus as shown in FIG. 9, as seen along the line 10—10 in FIG. 9.
Figure 11:
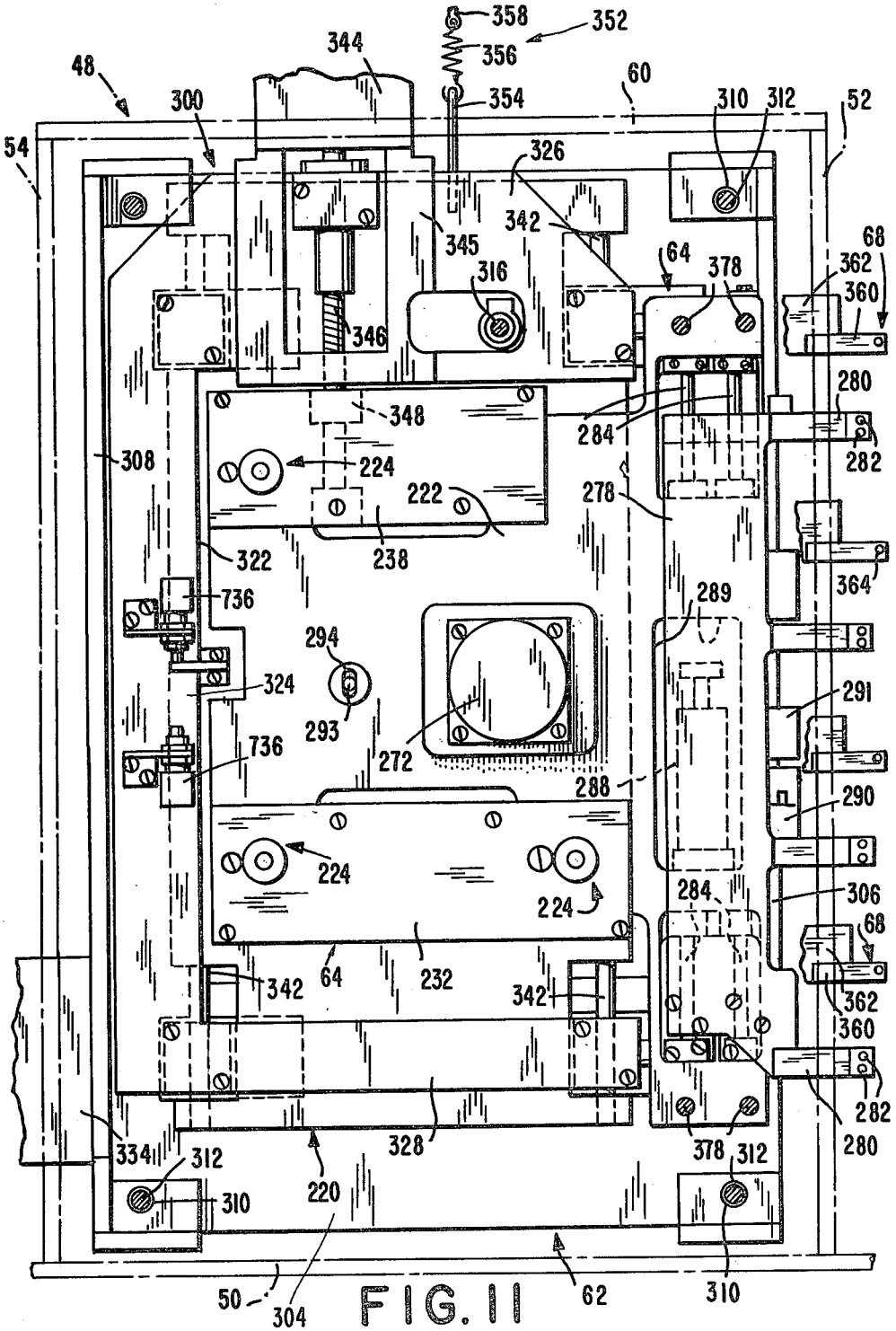
FIG. 11 is a side elevational view of the apparatus as shown in FIG. 9, as seen along the line 11—11 in FIG. 9.

Referring to FIGS. 10 and 11, in the disclosed apparatus two lower eccentric cam assemblies 224, and a third upper eccentric cam assembly 224, which is provided for additional stability, are utilized to mount the wrapping plate 222 (FIG. 11) on the Y-axis slide 220 for orbital movement. For example, as is shown in detail in FIG. 12 by way of illustration, one of the lower eccentric cam assemblies 224 includes an elongated eccentric cam shaft 226 disposed in a hollow drive shaft 228 which is journaled in a main support plate 230 of the Y-axis slide 220. One end of the eccentric cam shaft 226 also is journaled in a lower bearing support plate 232 suitably secured to the Y-slide main support plate 230 in spaced relationship with respect thereto, with the wrapping plate 222 disposed between plastic wear rings 234 mounted in the main support plate and the lower bearing plate. The plastic wear rings 234 also function as seals to define a sealed chamber 236 which may be filled with a suitable lubricant, not shown. The wrapping plate 222 is mounted between the main support plate 230 and the lower bearing support plate 232 in the second lower eccentric cam assembly 224, and between the main support plate and an upper bearing support plate 238 (FIG. 11) in the upper eccentric cam assembly 224, in the same manner.

The mounting of the wrapping plate 222 on the eccentric cam assemblies 224, as illustrated by the lower eccentric cam assembly 224 in FIG. 12, includes a hollow eccentric cam member 240 having a circular outer peripheral wall 242 rotatably supported in a suitable bearing 244 in the wrapping plate. The cam member 240 also includes first and second coaxial inner circular wall portions 246 and 248 which define an opening extending through the cam member and having a central axis offset with respect to the central axis of the outer peripheral wall 242 to produce an eccentric portion 250 on the cam member having a maximum eccentricity equal to an offset E-1 (FIG. 13). The second inner wall portion 248 of the cam member 240 is of a reduced diameter with respect to the diameter of the first inner wall portion 246, with opposed slots 252 in the cam member opening into the interior thereof through the second inner wall portion.

In addition, the eccentric cam shaft 226 includes a cylindrical cam portion 254 which is offset radially with respect to the axis of rotation of the cam shaft by an amount E-2 (FIG. 13) equal to one-half the desired change in orbital radius of the wrapping plate 222. For example, to achieve the above-mentioned range of an orbital radius of 0.075 to 0.100 inches, the eccentric offset would be 0.025/2 or 0.0125 inches. The circular inner wall portion 246 of the eccentric cam member 240 is supported on the cam shaft eccentric portion 254 by a pair of cylindrical drive rollers 256 which are disposed in longitudinally extending slots 258 formed in one end of the hollow drive shaft 228 and which extend into the slots 252 in the eccentric cam member 240 so that rotation of the drive shaft causes a corresponding rotation of the rollers and the cam member.

Thus, referring to FIG. 13, when the radially offset portion 254 of the cam shaft 226 is locked in a first rotatable position in the hollow drive shaft 228 in which the radially offset portion is on the opposite side of the cam shaft from the maximum point of eccentricity of the cam member 240, the eccentricity E-1 of the cam member with respect to the axis of rotation of the drive shaft is increased by the amount of the eccentricity E-2 produced by the radially offset portion, whereby the amount of orbital movement imparted to the wrapping plate 222 by rotation of the assembly comprising the drive shaft, the cam shaft and the cam member, is equal to the sum of the two eccentricities E-1 and E-2.

In contrast, when the eccentric cam shaft 226 is rotated 180° in the drive shaft 228 and the cam shaft is locked in a second rotatable position (not shown) in which the radially offset portion 254 of the cam shaft is on the same side of the cam shaft as the maximum point of eccentricity of the cam member 240, the effective eccentricity of the cam member with respect to the axis of rotation of the drive shaft, and thus the amount of orbital movement (wrap radius) imparted to the wrapping plate 222 is equal to the difference between the two eccentricities E-1 and E-2.

Thus, desired maximum and minimum radii for the wrapping plate assembly 64, depending on the spacing "d" (FIG. 40) between the terminals of the bobbins, can be obtained utilizing a cam member 240 having a maximum eccentricity E-1 equal to the maximum desired wrap radius minus ½ the difference between the desired maximum and minimum wrap radii, and by utilizing an eccentric cam shaft 226 having a radially offset portion 254 with a maximum radial offset E-2 equal to ½ the difference between the desired maximum and minimum wrap radii. For example, for a maximum wrap radius of 0.100 inches and a minimum wrap radius of 0.075 inches, as noted hereinabove, a cam member 240 having a maximum offset or eccentricity E-1 of 0.0875 inches and a cam shaft 226 having a radially offset portion 254 with a maximum offset or eccentricity E-2 of 0.0125 inches, will produce the wrap radii desired. In addition, by locking the cam shaft 226 in intermediate positions in the hollow drive shaft 228 and the cam member 240, values of wrap radii intermediate the maximum and minimum radii can be obtained, as desired.

At is left hand end as viewed in FIG. 12, a hub portion 256 of the eccentric cam shaft 226 has a toothed sprocket 258 secured thereto by suitable dowels. The toothed sprocket 258, and thus the eccentric cam shaft 226, can be releasably locked in a desired position in the drive shaft 228 and the cam member 240, to obtain a corresponding desired wrapping plate radius as above described, by a locking screw 250 extending through an essentially semicircular slot 262 (FIG. 10) in the sprocket and screw threadably mounted in a hub portion 264 of the drive shaft. The toothed sprocket 258 is connected to similar toothed sprockets 258 (FIG. 10) of the other eccentric cam assemblies 224 by a drive chain 266 to insure rotational adjustment of the cam assemblies in unison.

With further reference to the left hand side of FIG. 12, a drive sprocket 268 is secured to the drive shaft 228 of the first lower eccentric cam assembly 224. Referring to FIG. 10, the drive sprocket 268 is connected to a drive sprocket 270 of a reversible motor 272 (FIG. 11) adjustably mounted on the main support plate 230 (FIG. 10) of the Y-axis slide 220, and to a drive sprocket 268 of the upper eccentric cam assembly 224, by a timing belt 274 which also extends over an idler pulley 276 adjustably mounted on the Y-axis slide main support plate. While in the disclosed apparatus the second lower eccentric cam assembly 224 (FIG. 10) is not driven by the timing belt 274, so as to simplify the drive system, it is apparent that this eccentric cam assembly also may be driven by the timing belt, if so desired.

Figure 9:
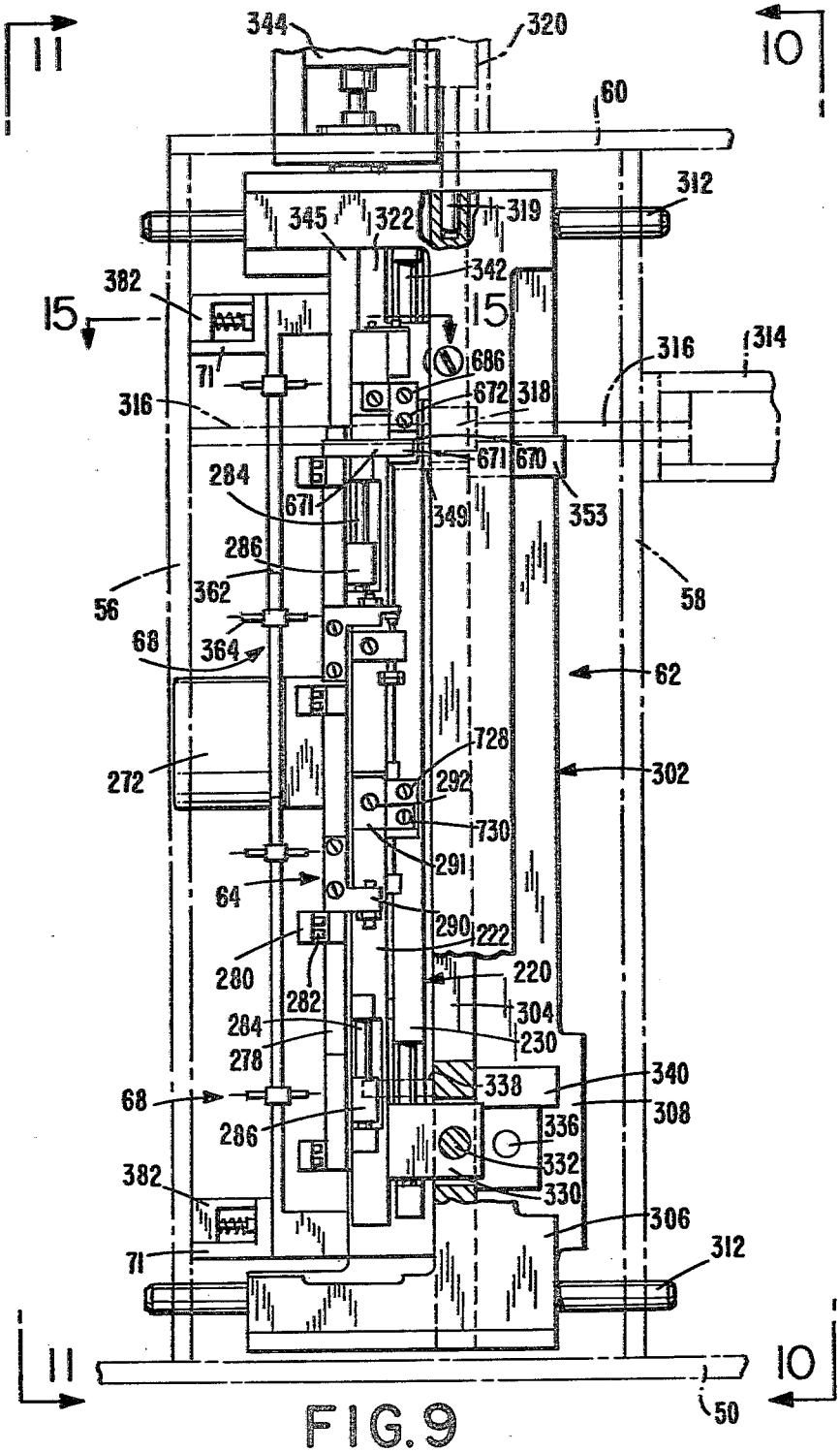
FIG. 9 is a front elevational view of the assemblies shown in FIG. 8, in conjunction with other portions of the apparatus, as seen along the line 9—9 in FIG. 1.

Referring to FIGS. 8, 9 and 11, the wire wrapping plate assembly 64 also includes a vertically disposed and vertically movable support slide 278 to which the lower needle wire guide assemblies 70 can be selectively transferred from the lower needle wire guide magazine assembly 66 for a bobbin winding operation. In this connection, a plurality of support arms 280 for respective ones of the lower wire guide assemblies 70 project outward from the support slide 278 in vertically spaced relationship and have projecting support dowels 282 mounted therein adjacent outer ends thereof.

More specifically, as is best shown in FIGS. 8 and 9, the support slide 278 is mounted on the wrapping plate 222 for vertical movement on upper and lower vertical guide rods 284 which are slidably received in brackets 286 secured to the support plate. The guide rods 284 are disposed in openings in the wrapping plate 222 and are mounted at their upper and lower ends in suitable brackets secured to the wrapping plate. The support slide 278 is vertically movable by an air cylinder 288 (FIGS. 10 and 11) between a lower position on the wrapping plate 222 in which the lower needle wire guide assemblies 70 can be transferred to and from the projecting arms 280 of the support plate, and an upper position on the wrapping plate for terminal wrapping and wire winding operations. The air cylinder 288 is disposed in an intermediate opening 289 in the wrapping plate 222, is fixedly mounted on the support slide 278, and has a piston rod connected at its upper end to the wrapping plate.

The upper limit of movement of the support slide 278 is controlled by a projecting arm 290 (FIG. 9) engaging a stop block 291 secured to the wrapping plate 222 by a screw 292. The stop block 291 can be selectively inverted on the wrapping plate 222 to present either of two opposite stop surfaces to the projecting arm 290 on the support slide 278, depending upon the wrap radius to which the wrapping plate is adjusted as above-described. The wrapping plate 222, and thus the support slide 278, can be selectively locked in a zero reference position by a lock pin 293 (FIG. 11) receivable in an aperture 294 in the wrapping plate and mounted on a piston rod of an air cylinder 295 (FIG. 10) secured to the Y-axis slide main support plate 230.

X, Y, Z Slide Assembly

With further reference to FIGS. 8, 9, 10 and 11, wherein FIGS. 9, 10 and 11 show the housing 48 and certain other related parts of the apparatus in phantom lines, in addition to the Y-axis slide 220 and the wire wrapping plate assembly 64 thereon, the X, Y, Z slide assembly includes an X-axis slide 300 which carries the Y-axis slide, and a Z-axis slide 302 which carries the X-axis slide. In this connection, for purposes of this description the apparatus is considered to have an X-axis which extends parallel to the longitudinal axes of the winding arbors 154 (FIG. 7), that is, from the front to the back of the apparatus, or in and out of the paper in FIG. 9. Further, the apparatus is considered to have a Z-axis which extends perpendicular to the longitudinal axes of the winding arbors 154, that is, from side-to-side in the apparatus as disclosed in FIG. 9.

The Z-axis slide 302 comprises a vertically disposed main plate 304 in the form of an open rectangular frame, as is best shown in FIG. 8, having a pair of vertical front and rear end plates 306 and 308 of essentially I-shaped configuration secured thereto. The Z-axis slide 302 is mounted for horizontal side-to-side movement in the apparatus as shown in FIG. 9 by bushings 310 (FIGS. 10 and 11) which are located in the vertical main plate 304 adjacent the corners thereof and which receive guide shafts 312 supported at their opposite thereof and which receive guide shafts 312 supported at their opposite ends in the vertical side mounting plates 56 and 58 of the housing 48. A reversible Z-axis drive motor 314 is mounted on the second side mounting plate 58 as illustrated in FIG. 9 and is connected by a drive screw 316 to a drive bushing 318 in the vertical main plate 304 of the Z-axis slide 302 for reciprocating the Z-axis slide, and thus the X-axis slide 300 and the Y-axis slide 220 mounted thereon. The Z-axis slide 302 can be selectively locked into a zero reference position with respect to the housing 48 by a lock pin 319 receivable in a recess in an upper edge of the vertical main plate 304 as illustrated in FIG. 9 and mounted on a piston rod of an air cylinder 320 mounted on the top cover mounting plate 60 of the housing 48.

The X-axis slide 300 is in the form of a vertically disposed plate member 322 of essentially C-shaped construction, as is best shown in FIG. 8, having a vertical bight portion 324 and upper and lower horizontal parallel arms 326 and 328, respectively. A front side of the C-shaped slide plate 322 is open as shown at the left-hand side of FIG. 8, to accommodate a body portion 329 of the orbitally movable wire wrapping plate 222.

The X-axis slide 300 is supported on the Z-axis slide 302 by a plurality of slide bushings 330 (e.g., four) which project from the upper and lower arms 326 and 328 of the C-shaped slide plate 322 and which receive respective ones of a plurality of horizontal guide shafts 332 mounted in suitable openings in the vertical main plate 304 of the Z-axis slide 302. The X-axis slide 300 is reciprocated by a reversible motor 334 (FIGS. 8 and 10) mounted on the rear end plate 308 of the Z-axis slide 302 and disposed in a rectangular opening in the rear vertical mounting plate 54 of the housing 48. The drive motor 334 is connected to a drive bushing portion of one of the slide bushings 330 of the X-axis slide 300 by a drive screw 336. The X-axis slide 300 can be selectively locked into a zero reference position with respect to the Z-axis slide 302 by a lock pin 338 (FIG. 9) receivable in an aperture in the X-axis slide and mounted on a piston of an air cylinder 340 mounted on the vertical main plate 304 of the X-axis slide.

The Y-axis slide 220 is supported for vertical movement on the X-axis slide 300 by vertical support shafts 342 mounted on the vertical main plate 230 of the Y-axis slide adjacent its corners and slidably received in the projecting slide bushings 330 in the X-axis slide. The Y-axis slide 220 is raised and lowered by a reversible motor 344 suitably mounted on the upper arm 326 of the X-axis slide 300 by means including a support plate 345 (FIG. 11) secured to the upper arm, the motor being connected by a drive screw 346 to a drive bushing 348 mounted on the vertical main plate 230 of the Y-axis slide.

As in the case of the X-axis slide 300, the Y-axis slide 220 can be selectively locked to the Z-axis slide 302 in a zero reference position by a lock pin 349 (FIG. 9) which is receivable in a preselected one of two apertures 350 (one shown in FIG. 10) in a block member 351 secured to the vertical main plate 230 of the Y-axis slide by screws 352 (only one shown). The lock pin 349 is mounted on a piston rod of an air cylinder 353 mounted on the vertical rectangular frame plate 304 of the Z-axis slide. In this regard, when the wrap radius of the wrapping plate 222 is modified as above-described, the elevation of the Y-axis slide 220 with respect to the lock pin 349 on the Z-axis slide 302 changes by the amount of the adjustment. Accordingly, the apertures 350 are located in the block member 351 so that when the apparatus is set for one wrap radius, the lock pin 349 is aligned with one of the apertures 350 in the block member. Then, when the apparatus is set for a second wrap radius, if the block member is inverted on the Y-axis slide 220, the lock pin 349 will be aligned with the second aperture 350 therein.

To reduce the size of the Y-axis drive motor 344 required, the Y-axis slide may be connected to a suitable counterweight mechanism 352 (FIG. 11) which may include, by way of example, a connector rod 354 secured to the top of the Y-axis slide and extending upward through an opening in the top cover mounting plate 60 to a shock-absorbing spring 356. A cable 358 then is connected at one end to the spring and extends over a pulley (not shown) and an upstanding support on the top cover mounting plate 60 of the housing 48, to a counterweight (not shown) secured to an opposite end of the cable.

Upper Needle Wire Guide Assemblies

Referring to FIG. 2, the wires 30-1 travel to the upper needle wire guide assemblies 68 from supplies (not shown) through eyelets in a pair of upstanding wire guide posts 359 at the front of the apparatus. Referring to FIGS. 9–11 and 15, the upper needle wire guide assemblies 68 are supported on the wrapping plate 222 of the wire wrapping plate assembly 64 for a bobbin winding operation on forwardly projecting vertically spaced arms 360 of a vertically disposed support plate 362. More specifically, as is best shown in FIG. 15, each of the upper needle wire guide assemblies 68 includes an elongated wire guide tube 364 mounted in a holder 366 by a clamping plate 368 so that opposite ends of the tube project beyond the holder. The holder 366, in turn, is secured to a support block 370 mounted on an outer end of a respective one of the projecting arms 360 of the vertical support plate 362.

As is best shown in FIGS. 9 and 15, the support plate 362 normally is locked to the wrapping plate 222 by sets of double acting air cylinders 372 and 373 (FIG. 15) having cylinder walls formed in enlarged portions of the support plate at its upper and lower ends. When pistons 374 of the air cylinders 372 and 373 are energized as shown in FIG. 15, first piston rods 376 on the pistons are received in recesses in the wrapping plate 222 to lock the support plate 362, and thus the upper needle wire guide assemblies 68, to the wrapping plate for movement therewith in a bobbin winding operation. When the upper needle wire guide assemblies 68 are not to be utilized in a bobbin winding operation, however, the pistons 374 are energized in a reverse direction to retract the first piston rods 376 from the recesses in the wrapping plate 222, thus releasing the support plate 362 from the wrapping plate. At the same time, second piston rods 378 on the pistons 374 are advanced into recesses in the lock-out plate storage members 71 located between the support plate 362 and the adjacent side mounting plate 56 (FIG. 9) at the upper and lower ends of the support plate, to lock the support plate 362 to the lock-out plate members in an inoperative position.

The lock-out plate storage members 71, which are of right-angle construction, as is best shown in FIG. 9, are suitably secured to second plate members 382, also of right-angle construction, and the resultant plate assemblies are secured to the vertical front mounting plate 52 and the adjacent side mounting plate 56 (FIG. 9). Spring loaded plungers 384 (FIG. 15) are mounted in the plate members 71 and 382 for reciprocal movement and are engageable by respective ones of the piston rods 378 of the air cylinders 372 and 373 for movement therewith. The plungers 384 include stop collars 386 which carry magnetic slugs 388 for operating respective sets of magnetic limit switches 602 and 604 (also shown in FIG. 37) for indicating whether the air cylinders are in their "lock-in" or "lock-out" condition.

With further reference to FIG. 15, the pistons 374 and their piston rods 376 and 378 are retained in the enlarged upper and lower end portions of the support block 362 by cylindrical metal end cap members 390 secured in the support block by suitable dowels 392, and are reciprocated by air introduced into the air cylinders 372 and 373 through suitable fittings 394 (shown only for the air cylinder 373). Further, the air cylinders 372 and 373 are disposed at oblique angles to one another as shown in FIG. 15 so as to lock the support plate 362 to the lock-out plate members 71 or the wrapping plate 222 against movement in all directions. In addition, supplemental locking mechanism (not shown), such as a type having a spring-loaded latching member, may be provided on the support plate 362 to further interlock the support plate to the movable wrapping plate 222, if so desired.

Lower Needle Wire Guide Magazine Assembly

Referring to FIG. 2, as noted hereinabove, the disclosed apparatus includes four sets (one for each winding arbor) of the lower needle wire guide assemblies 70, with one of the wire guide assemblies in each set being selectively operable for a bobbin winding operation at any one time. The magazine assembly 66, in which the lower needle wire guide assemblies 70 are stored when inoperative, is mounted on the vertical front mounting plate 52 of the apparatus. The magazine assembly 66 includes a main slide assembly 402 which is vertically movable into any one of three vertically spaced positions to locate a respective one (bottom, intermediate or upper) of the lower needle wire guide assemblies 70 in each set of the wire guide assemblies in a position for transfer to the vertically movable support slide 278 (FIG. 8) on the wire wrapping plate 222 (FIG. 8). In this regard, in FIG. 2 the intermediate lower wire guide assemblies 70 and their wires 30-3 are shown in a transferred position.

Referring to the left-hand side of FIG. 4, the magazine main slide assembly 402 includes a framework which comprises a pair of horizontally spaced front and rear vertical plates 404 and 406, respectively, and a pair of top and bottom plates 408 and 410, respectively, interconnected in a suitable manner. As is best shown in FIGS. 1 and 3, the main slide assembly 402 is supported for its vertical sliding movement on sets of vertically extending guide rods 412 received in projecting slide bushings 414 secured to the back of the rear plate 406 (FIG. 3) of the slide assembly. The guide rods 412 are disposed in vertical slots 416 in the vertical front mounting plate 52 and are supported at their upper and lower ends in suitable mounting blocks 418 (FIG. 3) secured in the slots.

The magazine main slide assembly 402 is movable vertically by a drive motor 420 (FIGS. 1, 2 and 3) connected to a drive screw 422 (FIG. 3) which extends through a drive bushing 424 (FIG. 3) fixedly mounted on the rear plate 406 of the slide assembly. The drive motor 420 is mounted on a cantilevered shelf portion of the top cover mounting plate 60 of the apparatus. At the lower end of the main slide assembly 402, its bottom plate 410 rests on a piston rod of an air cylinder 426 (FIG. 2) which supports the weight of the main slide assembly so as to reduce the lifting load on the drive motor 420. The main slide assembly 402 can be selectively locked in any one of its positions by a lock pin (not shown) on a piston rod of an air cylinder 427 (FIG. 3) mounted on the back of the front mounting plate 52, the lock pin being receivable in suitable apertures in the rear plate 406 of the main slide assembly for this purpose.

Referring to FIGS. 16 and 19, as in the case of the upper needle wire guide assemblies 68, each of the lower needle wire guide assemblies 70 includes an elongated wire guide tube 428 clamped in a holder 430 (shown only in FIG. 19) by a clamping plate 432 so that opposite ends of the tube project from the holder. Each wire guide holder 430 is releasably mounted on a support block 433 secured to one end of a horizontally movable secondary slide 434 of the magazine assembly 66. In this connection, referring to FIGS. 1, 16 and 17, the secondary slide 434 includes an elongated horizontally disposed body member 436 on which the support block 432 is mounted and which has oppositely projecting legs 438 at its opposite ends. The secondary slide 434 is mounted in the vertically movable main slide assembly 402 on guide rods 440 which extend between the legs 438 of the body member 436 and which are slidable in vertically extending support blocks 442 (FIGS. 16 and 17) and 444 (FIG. 17) secured to inner sides of the front and rear plates 404 and 406, respectively, of the main slide assembly.

Each of the secondary slides 434 is movable horizontally between a retracted position in which its associated lower needle wire guide assembly 70 is inoperative, and an advanced position for the transfer of the wire guide assembly to the support arms 280 (FIGS. 8 and 19) of the vertically movable slide 278 (FIG. 8) on the wire wrapping plate 222 (FIG. 8), for a bobbin winding operation. More specifically, with reference to FIGS. 19, 20 and 21, each wire guide holder 430 is releasably mounted on its support block 433 by a pair of latch pins 446 slidably mounted in the support block and each received at one end in an aperture in the holder. Opposite ends of the latch pins 446 are pivotally connected to an upper end of a lever 448 pivoted intermediate its ends on a pin 450 mounted in a slot in the support block 433. An opposite lower end of the lever 448 is engaged by a spring-biased reciprocal plunger 452 which is mounted in the associated secondary slide body member 436 and which normally holds the latch pins 446 in an extended locking position.

As is illustrated in FIG. 21, when the secondary slide 434 is advanced during a lower wire guide assembly transfer operation, the lever 448 engages and is pivoted by a cam 454, which is adjustably mounted in a slot on the front of the front mounting plate 52 (FIG. 14), to withdraw the latch pins 446 from the wire guide holder 430. At the same time, a pair of vertically spaced apertures 456 (FIGS. 17 and 19) in the wire guide holder 430 receive aligned ones of the peripherally grooved dowels 282 (FIGS. 14 and 19) on the projecting support arms 280 of the vertically movable slide 278 on the wire wrapping plate 222, and a pair of spring-loaded ball detents 458 (one shown in FIG. 19) in the wire guide holder then releasably lock the wire guide holder to the slide.

Horizontal advancement of the magazine secondary slides 434 which are in the transfer positions, for transfer of their wire guide holders 430 to their respective support arms 280 of the vertically movable slide 278 on the wire wrapping plate 222, is accomplished by a horizontally movable transfer slide 460 (FIG. 3) comprising a vertically disposed plate member 462 having a plurality of forwardly projecting pusher blocks 464 (best shown in FIGS. 16, 17 and 18) mounted thereon. The transfer slide 460 is mounted for reciprocal movement on horizontal guide rods 466 mounted at their opposite ends in suitable brackets 468 secured to the back of the vertical front mounting plate 52 of the apparatus. Reciprocation of the transfer slide 460 is accomplished by an air cylinder 470 mounted on the second vertical side mounting plate 58. A shock absorber 472 for the transfer slide 460 is mounted on a vertical support 474 secured to the back of the front mounting plate 52, and transfer slide stops 475 also are secured to the front mounting plate.

Referring to FIGS. 17 and 18, engagement of one of the magazine secondary slides 434 in each set of the slides with a respective one of the pusher blocks 464 on the transfer slide for a transfer operation is accomplished by moving the magazine main slide assembly 402 vertically until a tongue portion 476 (FIG. 18) of the pusher block, which extends through a horizontal slot 477 in the front mounting plate 52, becomes received in a groove 478 in the back of one of the body member legs 438 of the slide. At the same time the other secondary slides 434 are conditioned against horizontal movement by vertically aligned tongue portions 480 (best shown in FIG. 1) of vertically extending retaining bars 482 (FIGS. 1 and 3) which are fixedly mounted on the front surface of the vertical front mounting plate 52, and which become received in the grooves 478 in the body member legs 438 of these slides.

Referring to FIG. 2, an upstanding post 484 is mounted on the top plate 408 of the magazine main slide assembly 402 and has a bank of coaxially aligned wire guide pulleys 486 (only one shown), one for each of the wires 30-2, 30-3 and 30-4, supported thereon at its upper end. In operation of the apparatus, the wires 30-2, 30-3 and 30-4 extend from suitable supply reels (not shown) about the guide pulleys 486 and then downward about guide pulleys 488 mounted on outer ends of support arms 490 mounted at their inner ends on respective ones of the body members 436 of the magazine secondary slides 434 by brackets 492. As is best shown in FIG. 16, the wires 30-2, 30-3 and 30-4 then travel through respective eyelets 494 mounted on the tops of the slide body members 434 and through the lower needle wire guides 428 to their respective lower anchor pins 74. To reduce interference between the wires 30-2, 30-3 and 30-4 as they travel from the pulleys 486 on the post 484 to the pulleys 488 on the secondary slides 434, the support arms 490 for the pulleys are successively offset with respect to one another horizontally into different vertical planes, as illustrated at the right-hand side of FIG. 1.

Wire Anchor Pins and Stripper Mechanisms

Figure 14:
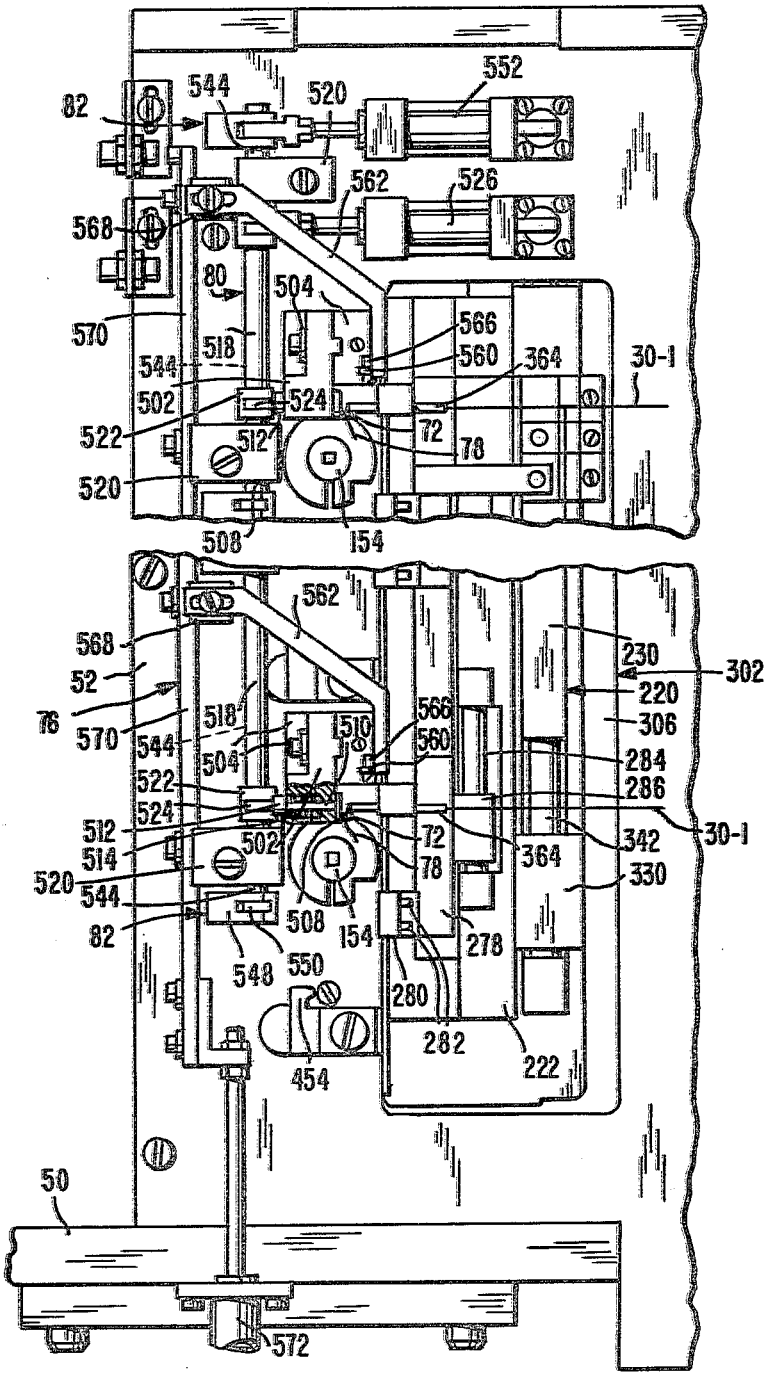
FIG. 14 is an enlarged partial front elevational view of a portion of the apparatus, as seen along the line 14—14 in FIG. 1.

The first and second scrap wire stripping mechanisms 80 (FIGS. 4 and 14) and 82 (FIGS. 4, 14, 19, 22 and 23) are of essentially identical construction. In this connection, each of the upper wire anchor pins 72 (FIG. 14) associated with the first scrap wire stripping mechanism 80 is fixedly mounted in a support block 502 mounted on an outer end of a projecting arm of a bracket 504 secured at an inner end to the front of the vertical front mounting plate 52. As is best shown in FIG. 14, portions of the first scrap wire stripping mechanism 80, including a wire stripping member 508 secured to one end of a reciprocal carrying rod 510, also are mounted in the support block 502. A cam button 512 is secured to the opposite end of the rod 510 and is biased to the left in FIG. 14 by a coil spring 514 disposed in the support block 502.

As described hereinabove, during a bobbin winding operation utilizing the wires 30-1, scrap wire pigtails 78 (FIGS. 14 and 24) formed on the upper wire anchor pins 72 by operation of the wire breaker mechanism 76, are stripped from the anchor pins by the first wire stripper mechanism 80. For this purpose, referring to FIGS. 4 and 14, the wire stripper mechanism 80 also includes a camming mechanism which comprises a vertically disposed cam shaft 518 journaled for rotation in support blocks 520 secured to the vertical front mounting plate 52. The cam shaft 518 includes a plurality of projecting actuating levers 522 mounted at inner ends on the shaft, with cam rollers 524 being mounted on outer ends of the levers and engaged with the cam buttons 512 on the wire stripper member carrying rods 510. Thus, upon rotation of the cam shaft 518 by an air cylinder 526 mounted on the front mounting plate 52, the cam rollers 524 cause the wire stripping members 508 to advance relative to the upper anchor pins 72 to strip the scrap wire pigtails 78 therefrom as illustrated in FIG. 23 for the lower anchor pins 74. At the same time, the stripped scrap wire pigtails 78 are blown vertically downward by air jets (not shown) suitably mounted adjacent the anchor pins 72, and the scrap wire pigtails drop through an opening in the main support table 50 into a suitable receptacle (not shown).

As is best shown in FIG. 19, each of the lower wire anchor pins 74 and portions of the second scrap wire stripping mechanism 82 are mounted on the secondary slides 434 of the lower needle wire guide magazine assembly 66. In this connection, each wire anchor pin 74 is fixedly mounted in the support block 433 of the secondary slide 434, and the second scrap wire stripping mechanism 82 includes a stripper member 534 mounted on one end of a carrying rod 536 slidably disposed in the support block, a cam button 538 mounted on the other end of the rod, and a biasing spring 540.

As in the case of the upper wire anchor pins 72, the second wire stripper mechanism 82 for the lower wire anchor pins 74 also includes a camming mechanism which comprises a vertically extending cam shaft 544 (FIGS. 4 and 14) journaled in the mounting blocks 520 and having projecting levers 548 of essentially C-shaped construction (see left-hand side of FIG. 1) mounted on the shaft. Cam rollers 550, which are engageable with the cam buttons 538 on the wire stripper member carrying rods 536 as selected ones of the magazine secondary slides 434 are moved to their advanced positions, are mounted on outer ends of perpendicularly extending leg portions of the levers 548. Thus, upon rotation of the camming mechanism 542 by an air cylinder 552 mounted on the vertical front mounting plate 52, the cam rollers 550 cause the stripping members to advance relative to the lower anchor pins 74 to strip the scrap wire pigtails 78 therefrom as illustrated in FIG. 23.

Wire Breaker Mechanism

Referring to FIG. 14, the wire breaker mechanism 76, for breaking the wires 30 between their respective upper and lower wire anchor pins 72 and 74 and the terminals 40 of the bobbins 32 being wound, includes a plurality of wire engaging breaker pins 560 mounted on lower ends of respective depending carrying arms 562. Each of the breaker pins 560 is of cylindrical construction and has a circular wire retaining ferrule 564 (FIG. 32) formed on an outer end of the pin. A triangularly shaped wire gathering plate 566 (best shown in FIGS. 32 and 33) also is secured to the lower end of each carrying arm 562 for guiding an engaged one of the wires 30 away from the adjacent bobbin flange 36 into engagement with the cylindrical breaker pin 560 on the arm. Upper ends of the carrying arms 562 are secured to forwardly projecting arms 568 (FIG. 14) on a wire breaker slide 570 in the form of an elongated bar member mounted for vertical reciprocal movement on the vertical front mounting plate 52.

At its lower end the wire breaker slide 570 is secured to a piston rod of an air cylinder 572 mounted beneath the main support table 50. Upon operation of the piston rod of the air cylinder 572 vertically downward, the wire breaker slide 570 is moved downward and the wires 30 are guided by the triangular plates 566 into engagement with the cylindrical breaker pins 560 closely adjacent the bobbin terminals 40, thereby stressing the wires and causing the wires to break in tension closely adjacent the terminals without any scrap wire segments extending from the terminals.

Operation

To facilitate an understanding of the operating sequence of the apparatus utilizing both the upper needle wire guides 364 and selected ones of the lower needle wire guides 428 in a bobbin winding operation, reference is made to the schematic representations in FIGS. 24–36, and the timing chart of FIGS. 38 and 39. In this connection, the timing chart of FIGS. 38 and 39 depicts a winding cycle in which both the upper needle wire guides 364 and one set of the lower needle wire guides 428 are being utilized. More specifically, the double cross-hatched areas indicate apparatus functions which are performed in a winding cycle regardless of whether the upper and lower needle wire guides 364 and 428 are both utilized, the left-to-right downward sloping cross-hatched areas indicate apparatus functions performed only when the upper wire guides are utilized, and the left-to-right upward sloping cross-hatched areas indicate apparatus functions performed only when the lower wire guides are utilized.

Figure 24:
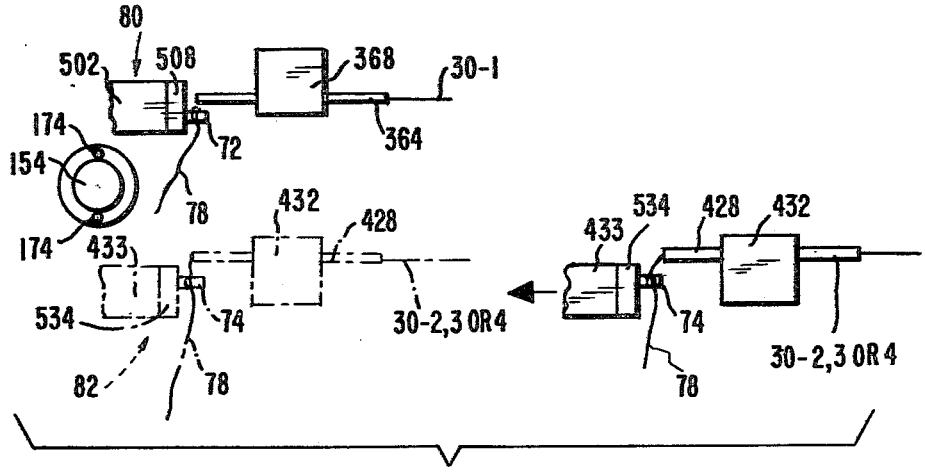

Initially, referring to FIG. 24, each of the upper needle wire guides 364 is located above its respective anchor pin 72, with its associated wire 30-1 wrapped on the pin and with a wire pigtail 78 formed on a previous cycle of operation extending from the pin. Similarly, each of the lower needle wire guides 428 is located in a retracted position in the magazine 66 above its respective anchor pin 74, with its associated wire 30-2, 30-3 or 30-4, wrapped on the pin and with a wire pigtail 78 from a previous winding cycle extending from the pin. Each of the lower needle wire guides 428 then is advanced to a position as illustrated in phantom lines in FIG. 24, in which it is vertically beneath its respective upper needle wire guide 364 and the same distance from the adjacent winding arbor 154 as the upper wire guide. As each of the lower needle wire guides 428 reaches its advanced position, its holder 430 becomes attached to a respective one of the support arms 280 on the vertically movable support slide 278 (FIG. 8) on the wrapping plate 222, as illustrated in FIGS. 19–21. At substantially the same time, a bobbin 32 is loaded onto each of the winding arbors 150 as illustrated in FIG. 25.

Figure 25:
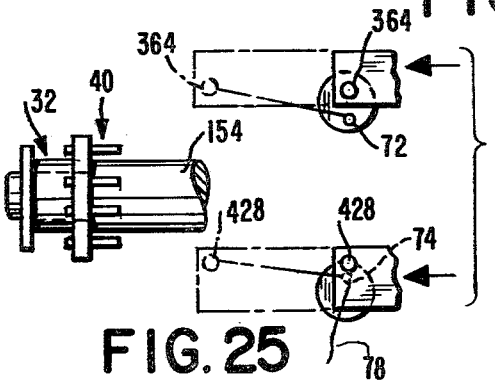

With further reference to FIG. 25, to avoid interference of the wire guides 364 and 428 with other portions of the apparatus, such as the anchor pins 72 and 74, the upper needle wire guides 364 and the advanced lower needle wire guides 428 then are shifted forward (to the left in FIG. 25) parallel to the winding arbors 154 by operation of the X-axis slide 300, into positions as shown in phantom lines, in which they are located approximately half-way between their start positions as shown in solid lines and a vertical plane extending through the portions of the terminals 40 on which the wires 30 are to be wrapped.

Figure 26:
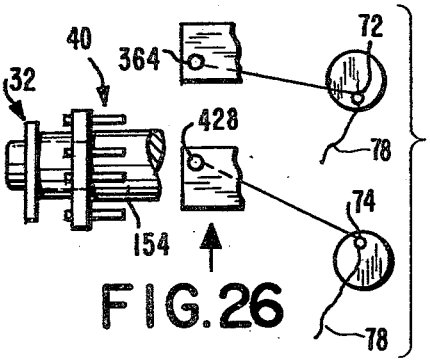
Figure 27:
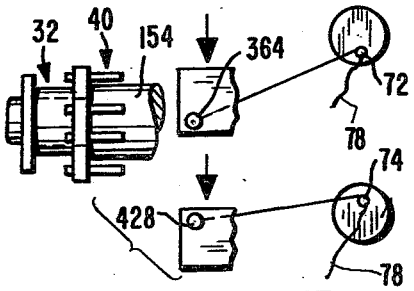
Figure 28:
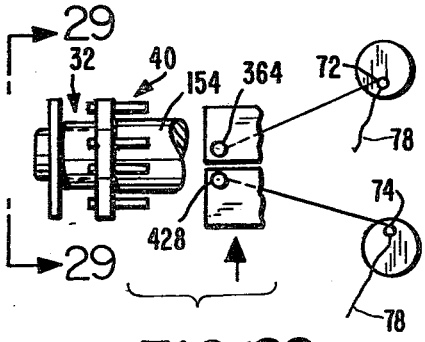

Referring to FIG. 26, the lower needle wire guides 428 then are raised or "closed" with respect to the upper needle wire guides 364 to a position approximately half-way between the upper and lower wire guides, by vertical movement of the support slide 278 on the wrapping plate 222. The upper and lower needle wire guides 364 and 428, respectively, then are moved vertically downward as a unit by operation of the Y-axis slide 220 until the upper needle wire guides are at their respective terminal wrapping levels as illustrated in FIG. 27. Closure of the lower needle wire guides 428 with respect to the upper needle wire guides 364, to bring the lower wire guides to terminal wrapping levels, then is completed as illustrated in FIG. 28. The sequential closure of the lower needle wire guides 428 in this manner precludes the formation of slack in each lower wire 30 between its lower wire guide and its respective anchor pin 74 as the upper needle wire guides 364 are moved downward to their terminal levels. The formation of slack in the lower wires 30 is undesirable since it may interfere with the wires subsequently being broken properly by the wire breaker mechanism 76.

Figure 29:
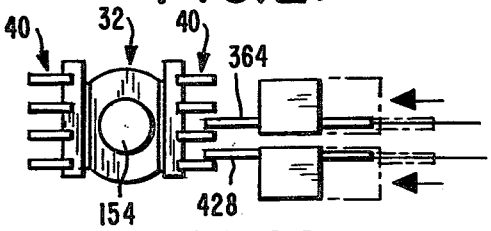
Figure 30:
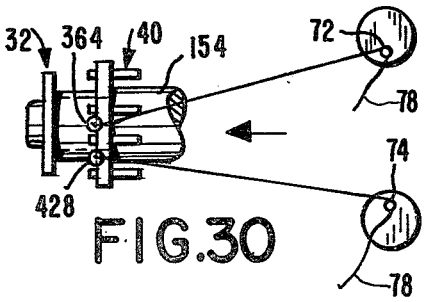

Referring to FIG. 29, as the upper and lower needle wire guides 364 and 428, respectively, are moved downward as shown in FIG. 27, the wire guides also are moved in toward the terminals 40 of the bobbins 32 into horizontal planes extending above their respective terminals, by operation of the Z-axis slide 302. Then, referring to FIG. 30, after the wire guides 364 and 428 have completed their movement in the Y and Z directions, the wire guides are moved horizontally forward (to the left in this figure) in an X direction into initial wire wrapping positions above their respective bobbin terminals 40.

The wires 30 extending through the upper and lower needle wire guides 364 and 428, respectively, then are wrapped on the adjacent bobbin terminals 40 a predetermined number of turns (e.g., four) as illustrated in FIG. 31 by orbital movement of the wrapping plate 222 and the lower wire guide support slide 278 thereon. The wire breaker mechanism 76 then is operated vertically downward so that the wire breaker pins 560 engage the wires 30 closely adjacent the terminals to break the wires at the terminals, as illustrated in FIG. 32. In this connection, referring to FIG. 33, as the wire breaker mechanism 76 is operated downward, each of the triangular wire camming plates 566 thereof engages its respective wires 30 to cam the wires outward away from the adjacent bobbin flange 36 into engagement with the associated wire breaker pin 560. The wire pigtails 78 on the anchor pins 72 and 74 then are stripped therefrom, as illustrated in phantom lines in FIG. 33.

Referring to FIG. 34, the upper and lower needle wire guides 364 and 428, respectively, next are positioned as a unit opposite the inside of the terminal-carrying flanges 36 of their respective bobbins 32 by operation of the X, Y and Z-axis slides 300, 220 and 302, respectively, and then are traversed as a unit back and forth between the bobbin flanges 36 by reciprocation of the X-axis slide as the arbors 154 are rotated, to wind a preselected number of turns on each of the bobbins in successive layers. The wire guides 364 and 428 then are moved to positions above the bobbin terminals 40 on which the thus formed windings are to be terminated, and are wrapped on the terminals by orbital movement of the wrapping plate 222, as shown in FIG. 35. Next, the wire guides 364 and 428 are returned to their anchor pins 72 and 74, respectively, in a reverse sequence to the sequence (FIGS. 25–30) in which they were moved to the initial bobbin terminals 40, and are again wrapped on the anchor pins, as shown in FIG. 36. The wires 30 between the anchor pins 72 and 74 and the last wrapped bobbin terminals 40 then are again broken adjacent the terminals by downward operation of the wire breaker mechanism 76 as illustrated in FIGS. 32 and 33, thus completing the winding cycle. The lower needle wire guides 428 then are moved back to their initial solid lines positions as illustrated in FIG. 24, and the apparatus proceeds to the next processing step.

Control of the apparatus to produce the desired operating sequence, as shown in the timing chart of FIGS. 38 and 39, can be accomplished in various manners utilizing a controller 600 (FIG. 37) which may be a programmed or punched-tape type device, contain suitable logic circuitry (not shown), or include a timing cam (not shown) and associated electrical circuits (not shown). The controller may cooperate with appropriately located limit switches on the apparatus as shown in FIG. 37, as for example model number #102MG11 magnetic limit switches available from the Micro-Switch Division of Honeywell, Inc., Freeport, Ill. 61032. In this connection, as noted hereinabove, the timing chart of FIGS. 38 and 39 depicts a winding cycle in which the upper wire guides 364 and one set of the lower wire guides 428 are both being utilized in the winding cycle.

With further reference to FIG. 37, which illustrates one manner of controlling the apparatus, at the beginning of the winding cycle the vertical support plate 362 for the upper needle wire guides 364 is in its normal "locked-in" operative position on the wire wrapping plate 222, being locked to the wrapping plate by the air cylinders 372 and 373. Thus, the magnetic discs 388 on the plungers 384 are operating the "lock-in" magnetic limit switches 602, while the "lock-out" magnetic limit switches 604 are not operated. The air cylinders 372 and 373 are energized into their "lock-in" condition as shown in FIG. 37 by respective double solenoid detented valves 606 and 608 of a type which remain set in the condition to which they have been energized, until they are energized again in a reverse direction. Thus, any possibility of the air cylinders 372 and 373 moving to the "lock-out" condition inadvertently, as for example in the event of a power failure, is eliminated.

In the timing chart of FIGS. 38 and 39, the vertically movable main slide assembly 402 of the lower needle wire guide magazine 66 has been prepositioned in a selected one of its three vertical positions by an operator utilizing selector switches (not shown) on a control panel (not shown) of the controller 600. For any subsequent cycle, however, the controller 600 is programmed to automatically cause raising or lowering of the main slide assembly 402, if necessary, for the next winding cycle, near the end of the present winding cycle (see time slots 41–45 on FIG. 39). As the main slide assembly 402 is raised and lowered, a magnetic disc (not shown) on a projecting arm of the slide assembly operates one of three magnetic limit switches 610, 612 or 614, respectively, to indicate to the controller 600 the vertical position of the slide. At this stage, a solenoid valve 616 also is energized and operating the magazine lock air cylinder 427, with an associated magnetic limit switch 618 closed and an associated magnetic limit switch 620 in an open condition.

At the beginning of the winding cycle, with an air supply 622 having been connected to the system by closure of a manual switch 624 to energize a solenoid valve 626, and with the apparatus in a start condition, four bobbins 32 are loaded in proper orientation on respective ones of the bobbin loading plungers 120. Positioning of the bobbins on the loading plungers 120 covers the bobbin presence sensor holes 130 (FIG. 6) in the plungers to energize the pressure sensitive electrical switch 140. Further, if all of the bobbins are properly positioned, whereby none of their orientation ribs 45 (FIG. 40) cause pivoting of the levers 146 on the nest members 126 to uncover one of the orientation sensor holes 32 in the nest members, and thus cause operation of the pressure sensitive electrical switch 142, the controller 600 becomes conditioned for the initiating of a coil winding operation. An operator then closes a start button (not shown) to initiate the coil winding cycle.

A solenoid valve 628 then is energized to operate the rotary actuator 102, to rotate the turret 84 of the bobbin loading mechanism 46 through 180°, causing opening of a magnetic limit switch 630 and closing of a magnetic limit switch 632 by magnetic discs (not shown) which may be suitably mounted in the upper mounting plate 94 of the turret. A solenoid valve 634 then is energized to operate the bobbin ejector air cylinder 206, causing rotation of the vertically disposed cam shaft 198 so as to advance the ejector rods 168 in the winding arbors 154, thus ejecting any previously wound bobbins 32 on the arbors into the part-receiving trays 148 on the bobbin loading mechanism 46. During the ejecting operation, a magnetic disc on a rearward extension of a piston rod of the air cylinder 206 moves away from a first magnetic limit switch 636 causing it to open, and moves opposite a second magnetic limit switch 638, causing it to close. Closure of the second limit switch 638 de-energizes the solenoid valve 634, whereupon the air cylinder 206 returns to its initial condition, reopening the second limit switch 638 and reclosing the first limit switch 636.

Next, the vertically disposed horizontally movable slide plate 106 on the turret 84 of the bobbin loading mechanism 46 is advanced as a result of downward movement of the camming plate 110 by the air cylinder 118 in response to the energization of a solenoid valve 640, to transfer the empty bobbins 32 on the loading plunger assemblies 88 onto the winding arbors 154. Operation of the air cylinder 118 causes opening of a magnetic limit switch 642 and closing of a magnetic limit switch 644, whereupon the solenoid valve 640 is de-energized to cause retraction of the air cylinder 118 and retraction of the camming plate 110 to its initial condition, thereby camming the slide plate 106 back to its initial position.

Retraction of the air cylinder 118 reopens the magnetic limit switch 644 and recloses the magnetic limit switch 642, whereupon the solenoid valve 628 is de-energized and the rotary actuator 102 returns the turret 84 of the bobbin loading mechanism 46 to its initial position for the reception of a new set of the empty bobbins 32. The return of the turret 84 to its initial position causes re-opening and reclosing of the magnetic limit switches 630 and 632, respectively.

After a short time delay following the initiation of the winding cycle, and simultaneously with the bobbin ejection-reloading steps above described, a double acting detenting solenoid valve 646 is energized to operate the air cylinder 470, causing the lower needle wire guide transfer slide 460 to advance the magazine secondary slides 434 in the secondary slide transfer positions, thus moving the lower needle wire guides 428 on these slides to advanced positions. As the lower needle wire guides 428 reach their advanced positions, they are transferred to the projecting arms 280 of the vertical support slide 278 on the wrapping plate 222. Upon advancement of the transfer slide 460, a magnetic disc thereon moves therewith to permit opening of a magnetic limit switch 648 and to cause closing of a magnetic limit switch 650.

At this time, the arbors 154 are in a zero reference position and terminals 40-1 through 40-4 (FIG. 40) of the bobbins 32 are in a wrapping position with a magnetic disc 651 on a member 652 mounted adjacent an outer end of the arbor motor shaft opposite and closing a "zero reference" magnetic limit switch 653. Then, after a short time delay following the return of the turret 84 of the bobbin loading mechanism 46 to its initial position, if the wires 30 initially are to be wrapped on respectives ones of bobbin terminals 40-5 through 40-8 (FIG. 40), a solenoid valve 654 is energized to operate the air cylinder 186, which retracts the locking bar 185 from the rearward extension on the shaft of the arbor drive motor 180. Operation of the air cylinder 186 moves a magnetic disc on a piston rod extension thereof to permit a magnetic limit switch 656 to open, and to close a magnetic limit switch 658. Upon closure of the limit switch 658, the arbors 154 are rotated through 180° to bring the terminals 40-5 through 40-8 (FIG. 40) into a wrapping position. In this connection, the arbor drive motor 180 initially is energized to begin rotation of the arbors 154. The magnetic disc 651 then cloes a magnetic limit switch 660 to de-energize the arbor motor 180, and to energize a magnetic hysteresis brake (not shown) which is suitably connected by a belt to the arbor motor drive shaft, to provide a braking action on the arbor motor so that the arbors rotate at a slow speed. The solenoid valve 654 then is de-energized and the air cylinder 206 moves the locking bar 185 back into engagement with the extension on the drive shaft of the arbor motor 180 to relocate the arbors 154 in a "180° from zero" position. At the same time, the magnetic disc 651 on the member 652 closes a magnetic limit switch 661, and the magnetic disc on the piston rod extension of the air cylinder 186 moves so that the limit switch 658 opens and the limit switch 656 is reclosed.

A solenoid valve 662 next is energized to operate the air cylinder 340 to unlock the X-axis slids 300, with movement of a magnetic disc on a piston rod extension of the air cylinder permitting opening and causing closing of magnetic limit switches 664 and 666, respectively. The X-axis slide drive motor 334 then is energized to move the upper needle wire guides 364 and 428 horizontally forward as a unit to their intermediate point spaced from the bobbins 32 on the winding arbors 154.

A solenoid 668 then is energized by the controller 600 to operate the air cylinder 288, which moves the vertical support slide 278 on the wrapping plate 222 upward to close the lower needle wire guides 428 to their intermediate point relative to the upper needle wire guides 364. In this connection, as the vertical support slide 278 moves upward, a magnetic disc on a projecting arm 669 permits a first magnetic limit switch 670 to open, and closes a second magnetic limit switch 672. In response to closure of the limit switch 672, the controller 600 energizes a pair of solenoid valves (not shown) to temporarily block air to both sides of the air cylinder 288.

At substantially the same time, the controller 600 energizes a solenoid valve 674 to operate the air cylinder 353 to unlock the Y-axis slide 220, with movement of a magnetic disc on a piston rod extension of the air cylinder permitting opening and causing closing of magnetic limit switches 676 and 678, respectively. A solenoid valve 680 also is energized to operate the air cylinder 320 to unlock the Z-axis slide 302, with operation of this air cylinder opening and closing magnetic limit switches 682 and 684, respectively.

The Y-axis slide motor 344 and the Z-axis slide motor 314 then are energized simultaneously to move the upper and lower needle wire guides 364 and 428, respectively, as a unit downward to the terminal wrapping level for the upper wire guides, and inward toward the winding arbors 154 to the vertical wrapping plane for both sets of the wire guides. The controller 600 then de-energizes the above-mentioned solenoid valves (not shown) blocking air to the air cylinder 288, whereupon this air cylinder completes its upward movement to raise the vertical support slide 278 to its uppermost position, thus completing the closure of the lower needle wire guides 428 to their terminal wrapping level. As a result of the continued upward movement of the support slide 278, the magnetic disc thereon also moves to permit opening of the magnetic limit switch 672 and cause closing of a magnetic limit switch 686.

Upon closure of the limit switch 686, the X-axis slide motor 334 is again energized to move the upper and lower needle wire guides 364 and 428, respectively, horizontally forward to their wrapping positions above respective ones of the bobbin terminals 40. A solenoid 688 then is energized to operate the air cylinder 295 to unlock the wrapping plate 222, with movement of a magnetic disc on a piston rod extension of the air cylinder permitting opening of a magnetic limit switch 690 and causing closing of a magnetic limit switch 692.

Upon closure of the limit switch 692, the wrapping plate motor 272 is energized to orbit the wrapping plate 222, thus orbiting the upper and lower needle wire guides 364 and 428 as a unit about their respective starting bobbin terminals 40 (FIG. 40), until a desired number of turns of the wires 30 have been wrapped on the terminals. The wires 30 may be wrapped on the terminals 40 in either a clockwise or counterclockwise direction, depending on the terminals involved, so that the wires subsequently extend from the terminals to the hubs 34 of the bobbins 32 in spaced relationship to the adjacent bobbin flanges 36. Thus, if the wires 30 are initially being wrapped on the bobbin terminals 40-1 and 40-2 in FIG. 40, the wires are wrapped on the terminals clockwise. However, if the wires initially are being wound on the bobbin terminals 40-3 and 40-4 in FIG. 40, the wires are wrapped on the terminals counterclockwise.

At the completion of the terminal wrapping step, the wrapping plate motor 272 is de-energized to stop the wrapping plate 222 in its zero reference position, this condition being detected by a magnetic disc on the drive pulley of the motor energizing an adjacent magnetic limit switch 694. The solenoid valve 688 then is de-energized and the air cylinder 295 operates to relock the wrapping plate in its zero reference position, while at the same time permitting opening of the magnetic limit switch 692 and causing reclosing of the magnetic limit switch 690.

A solenoid valve 696 then is energized to operate the air cylinder 572 to move the wire breaker mechanism 76 downward to break the wires 30 between the anchor pins 72 and 74, and the just wrapped bobbin terminals 40. Downward movement of the wire breaker mechanism 76 causes a magnetic disc 698 thereon to permit a magnetic limit switch 700 to open, while closing a magnetic limit switch 702. Closure of the magnetic limit switch 702 de-energizes the solenoid valve 696, whereupon the air cylinder 572 restores the wire breaker mechanism 76 to its initial condition, thus opening the limit switch 702 and reclosing the limit switch 700.

Closure of the limit switch 700 causes energization of solenoid valves 704 and 706 to operate the air cylinders 526 and 552, respectively, to cause the wire stripping mechanisms 80 and 82 to strip the wire pigtails 78 from their respective anchor pins 72 and 74. Operation of the air cylinder 526 causes opening and closing of magnetic limit switches 708 and 710, respectively, and operation of the air cylinder 552 dauses opening and closing of magnetic limit switches 712 and 714, respectively. Closure of the limit switches 710 and 714 causes de-energization of their respective solenoid valves 704 and 706, whereby the air cylinders 526 and 552 restore the wire stripper mechanisms 80 and 82 to their initial positions, thus opening the limit switches 710 and 714, and reclosing the limit switches 708 and 712.

Upon closure of the magnetic limit switches 708 and 712 at the end of the wire stripping operation, the X-axis motor 334 is again energized to move the upper and lower needle wire guides 364 and 428 as a unit into positions opposite the adjacent terminal-carrying bobbin flange 36 (FIG. 34) for a wire winding operation. The above-mentioned magnetic brake (not shown) then is de-energized to release the braking action on the arbor drive motor 180 during the subsequent winding operation, and the Y-slide motor 344 and the Z-slide motor 314 are energized to move the needle wire guides 364 and 428 as a unit into initial winding positions.

The solenoid valve 654 then is again energized to operate the air cylinder 186 to retract the locking bar 185 from the shaft extension on the arbor motor 180, with the magnetic limit switch 656 opening and the magnetic limit switch 658 closing. The arbor motor 180 then is energized to begin rotating the arbors 154 and the bobbins 32 thereon. At the same time the X-slide drive motor 334 is energized to reciprocate the needle wire guides 364 and 428, to wind the wires 30 on the bobbins 32 in successive layers. When the desired number of wire turns have been formed on the bobbins 32, as indicated to the controller 600 by the magnetic disc 651 on the member 652 at the outer end of the motor drive shaft operating a turns counting magnetic limit switch 716, the X-slide drive motor 334 is de-energized. The solenoid valve 654 then is de-energized to restore the air cylinder 186, locking bar 185 and the magnetic limit switches 655 and 656 to their initial condition.

If the wires 30 initially were terminated on selected ones of the terminals 40-5 through 40-8 (FIG. 40) of the bobbins 32, whereby the bobbins now are in their "180° from zero" reference position, and if the wires are to be finish-terminated on selected ones of the terminals 40-1 through 40-4, the arbors 154 next are rotated through 180° (steps 27 and 28 of FIG. 38) as above described, to locate the bobbins in their "zero" reference position. During this rotation, the magnetic limit switch 716 is operated by the magnetic disc 651 at the outer end of the arbor motor drive shaft, to de-energize the arbor motor 180 and to energize the above-mentioned magnetic brake (not shown).

Following completion of the bobbin winding operation, and the preceding 180° rotation of the arbors 154 when performed, the X, Y and Z-slide drive motors 334, 344 and 314, respectively, are energized to move the needle wire guides 364 and 428 to positions above their bobbin terminals 40 on which the wires are to be finish-terminated. The solenoid 688 then is again energized to retract the wrapping plate lock cylinder 295 and the motor 272 is energized to wrap the wires 30 on the terminals 40, after which the solenoid 688 is de-energized so that the wrapping plate air cylinder operates to relock the wrapping plate 222, as above described.

The needle wire guides 364 and 428 then are returned to their "zero" reference positions above their respective anchor pins 72 and 74 in a reverse sequence to that in which they were moved to their respective starting bobbin terminals, as described hereinabove, under the direction of the controller 600. For this purpose, the X, Y and Z-slide motors 334, 344 and 314, respectively, are selectively energized, the solenoid valve 688 is de-energized to operate the air cylinder 288, thus lowering the lower needle wire guide support slide 278 on the wrapping plate 222 to its lower open position, and the above-mentioned solenoid valves for blocking air to the air cylinder 288 to temporarily interrupt its slide opening movement are energized and then de-energized, in the appropriate sequence for this purpose.

Upon magnetic discs on the X, Y and Z-axis slides 300, 220 and 302, respectively, closing respective magnetic limit switches 717, 718 and 719, the solenoid valves 662, 674 and 680 are de-energized so that the lock cylinders 340, 353 and 320 operate to relock their respective slides in their zero reference positions. At the same time, upon closure of the magnetic limit switch 670 associated with the lower wire guide support slide 278, the solenoid 688 is energized to operate the air cylinder 295 and unlock the wrapping plate 222, again opening the magnetic limit switch 690 and reclosing the magnetic limit switch 692. The wrapping plate motor 272 then is energized to wrap-terminate the wires 30 on the anchor pins 72 and 74.

The wire breaker mechanism 76 next is operated downward as above-described to break the wires 30 between the finishing terminals 40 and the anchor pins 72 and 74. Upon reclosing of the limit switch 700 as the wire breaker mechanism 76 returns to its upper position, the solenoid valve 646 is de-energized to operate the magazine slide air cylinder 470 to return the lower needle wire guides 428 to their retracted storage positions in the magazine assembly 66.

If tape is to be applied to the just completed windings by the tapers 83 (FIG. 2), the arbors 154 then are unlocked and rotated (steps 41 and 42 in FIG. 38) as above-described until the desired number of tape turns have been applied to the winding. The arbors 154 then are relocked against movement by the arbor motor locking bar 185 as above-described.

Near the end (time slot 46 in FIG. 38) of the winding cycle, if the winding arbors 154 are in their "180° from zero" reference position as a result of the wires 30 having been wrap-terminated on selected ones of the terminals 40-5 through 40-8, without the arbors having been returned to their zero reference positions in a taping operation, the arbors are rotated 180° into their zero reference positions as above described, in preparation for the next winding cycle.

When the upper needle wire guides 364 are not being utilized in a winding operation, the controller 600 is programmed to omit the apparatus functions (indicated by cross-hatching sloping downward to the right in FIGS. 38 and 39) performed solely in conjunction with the use of the upper wire guides. Similarly, when the lower wire guides 428 are not being used in a winding operation, the apparatus functions (indicated by cross-hatching sloping upwardly to the right in FIGS. 38 and 39) are omitted from the winding operation.

In adjusting the eccentric cam assemblies 224 to change the wrap radius of the wrapping plate 222, suitable indicating switches are provided as illustrated schematically in FIG. 37. For example, when the eccentric cam shaft 226 and the sprocket 258 of the eccentric cam assembly 224 shown in FIG. 37 are in a first of their operating positions, a first magnetic disc 720 on the sprocket closes a first magnetic limit switch 722, with a second magnetic limit switch 724 being open. When the eccentric cam shaft 226 and the sprocket 258 are rotated into their second operating positions, a second magnetic disc 726 on the sprocket closes the second magnetic limit switch 724, and the first magnetic limit switch is open. Further, as the lock pin-receiving block 351 on the Y-axis slide 220 is inverted between its two operating positions, magnetic discs thereon selectively close respective magnetic limit switches 728 and 730. Similarly, as the stop block 291 for the lower needle wire guide support slide 278 is inverted between its two operating positions, magnetic discs on the block selectively close respective magnetic limit switches 732 and 734.

Position control of the X, Y and Z-axis slide motors 334, 344 and 314, respectively, with respect to their zero reference positions, may be accomplished electrically in any suitable manner. For example, each of the motors 334, 344 and 314 may be of a stepping type which includes a photoelectric tachometer-encoder in the same housing for transmitting pulses representative of the motor's rotation to suitable logic and up-down counter circuits (not shown) in the controller 600 for monitoring the relative positions of the motors with respect to their zero reference positions during the winding cycle. In this connection, a motor-tachometer-encoder unit suitable for this purpose is the model #U9M4H/U6/OT motor and model #OP-OU909-078 tachometer-encoder, available from the PIM Motors Division of the Kollmorgen Corporation, Syosset, N.Y. Travel of the X, Y or Z-axis slides beyond desired operating limits in the event of a malfunction in the control system may be precluded by suitable overtravel limit switches 736, as for example, are shown in FIG. 10 for the X-axis slide 300.

Control of the X-axis slide motor 334 to reciprocate or traverse the upper and/or lower needle wire guides 364 and 428, respectively, during the winding of the wires 30 on the bobbins 32, may be accomplished by a motor control system of a type in which the motor drives a photoelectric tachometer-encoder 738 (FIG. 37) as is disclosed in the copending patent application of J. M. Blackburn and D. C. Paschall, Ser. No. 85,343, filed on even date herewith and assigned to the same assignee, and entitled "A system for Controlling the In-Phase Operation of a Pair of Motors," the disclosure of which is hereby incorporated by reference. In that application a tachometer-encoder, such as the tachometer-encoder 738, converts the rotational speed of an arbor drive motor, such as the arbor drive motor 180, to a frequency representative of the speed of the motor, which is driven at a constant speed. The frequency of a traverse motor, such as the X-slide motor 334, then is compared with a modified arbor motor frequency, and if there is a phase difference between the two frequencies, a signal is generated to adjust the speed of the traverse motor accordingly. For this purpose the arbor drive motor 180 may be the model #MF-19 motor, and the tachometer-encoder 720 may be the model #U9M4 optical tachometer-encoder, of the PMI Motors Division of the Kollmorgen Corporation.

Industrial Application

In summary, apparatus has been disclosed for selectively winding strands, such as the wires 30-1, 30-2, 30-3 and 30-4, which may be of different gauges, on support members, such as bobbins 32 (FIG. 40). More specifically, the disclosed apparatus is capable of selectively winding the wires 30-1, 30-2, 30-3 or 30-4 on the bobbins 32 singly, or winding the wires 30-1 on the bobbins in parallel with selected ones of the wires 30-2, 30-3 or 30-4.

In this connection, referring to FIG. 15, the upper needle wire guides 364 may be selectively locked to the wire wrapping plate 222 for a bobbin winding operation, or to the "lock-out" storage plates 71 in inoperative positions, by selective energization of the air cylinders 372 and 373. Similarly, the lower needle wire guides 428 may be selectively transferred from the magazine assembly 66 onto the support slide 278 on the wire wrapping plate 222 for a bobbin winding operation by moving the main slide assembly 402 vertically to locate the selected secondary slides 434 in their transfer positions, as illustrated in FIG. 2, and then advancing the secondary slides to the vertical support slide as illustrated in FIGS. 2 and 19–21. In addition, the upper needle wire guides 364 and selected ones of the lower needle wire guides 428 may be transferred to the wire wrapping plate 222 for winding the wires 30-1 on the bobbins 32 in parallel with the wires 30-2, 30-3 or 30-4.

Thus, the disclosed apparatus is capable of winding wires 30 of different gauges on the bobbins 32 either singly or in parallel in successive winding cycles, without stopping the apparatus to change supply reels and to rethread new wires through the apparatus, as has been the case in prior known apparatus. In addition, the wire wrapping radius of the wire wrapping plate 222 can be varied in accordance with the spacing "d" (FIG. 40) between the terminals 40 of the bobbins 32, by adjustment of the eccentric cam shafts 226 in the eccentric cam assemblies 224 (FIGS. 12 and 13). Thus, the magnitude of orbital movement of the wires guides 364 and 428 about the terminals 40 can be modified so as to be coaxial with the terminals being wrapped, whereby the apparatus is capable of winding bobbins 32 having different terminal spacings without the wire guides striking the terminals being wrapped and/or adjacent terminals.

What is claimed is:

1. Apparatus for selectively winding strands on a support member, which comprises:

a guide for each of the strands in which the strand is disposed during a winding operation;

moving means for moving each of the strand guides when the strand guide is mounted on the moving means, to locate the strand guide and the strand in the strand guide in a winding position;

means for rotating the support member to pull the strand in each of the strand guides which is located in the winding position through the strand guide, and to wind the strand on the support member;

storage means for storing the strand guides when the strand guides are not mounted on the strand guide moving means; and transfer means for selectively transferring the strand guides from the storage means to the strand guide moving means for a winding operation, and back to the storage means upon the completion of a winding operation.

2. Apparatus for selectively winding strands on a support member, which comprises:

a guide for each of the strands in which the strand is disposed during a winding operation;

orbiting means for orbiting each of the strand guides in an orbital path when the strand guide is mounted on the orbiting means, to wrap the strand in the strand guide on the support member;

moving means for moving the orbiting means to locate each strand guide on the orbiting means and the strand in the strand guide in a winding position;

means for rotating the support member to pull the strand in each of the strand guides which is located in the winding position, through the strand guide, and to wind the strand on the support member;

storage means for storing the strand guides when the strand guides are not mounted on the strand guide orbiting means; and transfer means for selectively transferring the strand guides between the storage means and the strand guide orbiting means.

3. Apparatus as recited in claim 2, in which:

the strand guide moving means further includes a slide assembly movable in X, Y and Z directions which extend perpendicular to one another, the orbiting means being mounted on the slide assembly.

4. Apparatus as recited in claim 2, in which:

the transfer means transfers a first of the strand guides to the orbiting means into a fixed position on the orbiting means; and the orbiting means includes movable strand guide support means to which a second of the strand guides is transferred by the transfer means, such that the second strand guide is movable relative to the first strand guide when the first and second strand guides are supported on the orbiting means.

5. Apparatus as recited in claim 2, in which the support member includes first and second strand terminating members in a preselected spaced relationship and in which the orbiting means includes:

an orbiting member movable in an orbital path to orbit first and second ones of the strand guides about respective ones of the first and second terminating members to wrap first and second ones of the strands in the strand guides on the terminating members;

support means for the first strand guide transferable from the storage means by the transfer means into a fixed position on the orbiting member;

support means for the second strand guide slidably mounted on the orbiting member for movement relative to the first strand guide support means when the first strand guide support means is mounted on the orbiting member; and means on the orbiting member for moving the second strand guide support means relative to the first strand guide support means to locate the first and second strand guides in a spaced relationship essentially corresponding to the spaced relationship of the first and second strand terminating members on the support member, for wrapping the first and second strands on respective ones of the first and second terminating members simultaneously.

6. Apparatus as recited in claim 5, which further comprises:

first and second spaced anchor means for anchoring portions of the first and second strands in the first and second strand guides against movement, the second strand guide support means on the orbiting member also being movable relative to the first strand guide support means into a spaced relationship essentially corresponding to the spacing between the first and second anchor means, for wrapping the first and second strands on the first and second anchor means simultaneously.

7. Apparatus as recited in claim 1, in which:

the storage means includes at least first, second and third storage means for respective first, second and third ones of the strand guides; and the transfer means includes first transfer means for selectively transferring the first strand guide between its storage means and the strand guide moving means, and includes second transfer means for selectively transferring the second and third strand guides between their respective storage means and the strand guide moving means.

8. Apparatus as recited in claim 7, which further comprises:

a first slide mounted for reciprocal movement in first directions;

a plurality of second slides mounted on the first slide for reciprocal movement in second directions perpendicular to the first directions, the second guide storage means and the third strand guide storage means being mounted on respective ones of the second slides:

means for moving the first slide to locate one of the second slides in a position for transfer of the strand guide storage means thereon to the strand guide moving means;

means for moving the second slide in the transfer position toward the strand guide moving means to transfer the strand guide on the second slide to the strand guide moving means; and means for precluding movement of the other second slides with the second slide in the transfer position.

9. Apparatus as recited in claim 2, in which the support member includes spaced strand terminating members, and which further comprises:

separate means for anchoring portions of respective ones of the strands against movement;

means for operating the orbiting means to selectively wrap each of the strands on one of the terminating members of the support member when the strand guide for the strand is mounted on the orbiting means; and means for breaking each wrapped strand in tension between the anchor means for the strand and the terminating member on which the strand is wrapped, the strand breaking means being movable into engagement with the strand closely adjacent the terminating member in a direction extending substantially perpendicular to the strand.

10. Apparatus as recited in claim 9, in which:

the strand breaking means includes a cylindrical pin engageable with the strand to break the strand.

11. Apparatus as recited in claim 10, in which:

the strand breaking means includes strand gathering means for engaging the strand to pull the strand away from adjacent structure of the support member and into engagement with the cylindrical pin.

12. Apparatus as recited in claim 11, in which: the strand gathering means is a triangularly shaped camming member mounted adjacent the cylindrical pin.

13. Apparatus as recited in claim 1, which further comprises:

a rotatable turret;

means mounted on the rotatable turret for receiving the support member;

means for rotating the turret to move the support member-receiving means between a support member-receiving position and a position for loading the support member on the support member rotating means; and means for moving the support member-receiving means linearly on the turret when the support member-receiving means is in the loading position, to transfer the support member from the support member-receiving means to the support member rotating means.

14. Apparatus as recited in claim 13, which further comprises:

a receptable mounted on the turret for rotation therewith; and means for ejecting a wound support member from the support member rotating means into the receptacle.

15. Apparatus as recited in claim 2, for selectively winding a plurality of strands on support members which include strand terminating members in different spaced relationships, and in which:

the orbiting means includes means for changing the radius of orbital movement of the orbiting means.

16. Apparatus as recited in claim 2, for selectively winding a plurality of strands on support members which include first and second strand terminating members in different spaced relationships, and in which the orbiting means includes:

an orbiting member movable in an orbital path to orbit first and second ones of the strand guides about respective ones of the first and second strand terminating members to wrap first and second strands on the first and second strand terminating members, respectively;

hollow eccentric cam means rotatably mounted in the orbiting member; S a rotatable hollow drive shaft extending into the hollow eccentric cam means, the eccentric cam means having an eccentric portion which is offset with respect to an axis of rotation of the drive shaft;

a cam shaft extending coaxially through the hollow drive shaft and including an eccentric cylindrical cam portion which is offset with respect to the axis of rotation of the drive shaft, the eccentric cam portion of the cam shaft being located in the hollow eccentric cam means and the cam shaft being adjustably rotatable in the hollow drive shaft into preselected positions to change the radius of orbital movement of the orbiting member;

means for securing the cam shaft to the hollow drive shaft for rotation therewith; and connecting means for drivingly connecting the drive shaft to the eccentric cam means.

17. Apparatus as recited in claim 16, in which:

the connecting means includes a pair of cylindrical rollers partially disposed in slots in the hollow drive shaft and partially disposed in slots in the hollow eccentric cam means, the rollers also being located on opposite sides of the eccentric cam portion of the cam shaft.

18. Apparatus for wrapping a strand on a terminating member, which comprises:

a strand guide through which the strand travels from a supply of the strand as the strand guide is orbited about the terminating member;

orbiting means for orbiting the strand guide about the terminating member to wrap the strand on the terminating member, the orbiting means including an orbiting member movable in an orbital path to move the strand guide about the terminating member to wrap the strand on the terminating member;

hollow eccentric cam means rotatably mounted in the orbiting member;

a rotatable hollow drive shaft extending into the hollow eccentric cam means, the eccentric cam means having an eccentric portion which is offset with respect to an axis of rotation of the drive shaft;

a cam shaft extending coaxially through the hollow drive shaft and including an eccentric cylindrical cam portion which is offset with respect to the axis of rotation of the drive shaft, the eccentric cam portion of the cam shaft being located in the hollow eccentric cam means and the cam shaft being adjustably rotatable in the hollow drive shaft into preselected positions to change the radius of orbital movement of the orbiting member;

means for securing the cam shaft to the hollow drive shaft for rotation therewith; and connecting means for drivingly connecting the drive shaft to the eccentric cam means.

19. Apparatus as recited in claim 18, in which:

the connecting means includes a pair of cylindrical rollers partially disposed in slots in the hollow drive shaft and partially disposed in slots in the hollow eccetric cam means, the rollers also being located on opposite sides of the eccentric cam portion of the cam shaft.

20. A mechanism for orbiting a member in an orbital path, which comprises:

a support member for the member to be moved in the orbital path;

hollow eccentric cam means rotatably mounted in the support member;

a rotatable hollow drive shaft extending into the hollow eccentric cam means, the eccentric cam means having an eccentric portion which is offset with respect to an axis of rotation of the drive shaft;

a cam shaft extending coaxially through the hollow drive shaft and including an eccentric cylindrical cam portion which is offset with respect to the axis of rotation of the drive shaft, the eccentric cam portion of the cam shaft being located in the hollow eccentric cam means and the cam shaft being adjustably rotatable in the hollow drive shaft into preselected positions to change the radius of orbital movement of the support member;

means for securing the cam shaft to the hollow drive shaft for rotation therewith; and connecting means for drivingly connecting the drive shaft to the eccentric cam means.

21. Apparatus as recited in claim 20, in which:

the connecting means includes a pair of cylindrical rollers partially disposed in slots in the hollow drive shaft and partially disposed in slots in the hollow cam member, the rollers also being located on opposite sides of the eccentric cam portion of the cam shaft.

22. Apparatus for selectively winding a plurality of wires on bobbins in which each of the bobbins includes terminals in a preselected spaced relationship;

a plurality of spaced anchor means for anchoring portions of respective ones of the wires against movement;

a wire guide for each wire through which the wire travels from a supply of the wire as the wire guide is moved relative to the anchor means to which the wire is anchored and as the wire is wound on one of the bobbins;

a slide assembly having slides movable in X, Y and Z directions which extend perpendicular to one another;

an orbiting member mounted on the slide assembly, the orbiting member being movable in an orbital path for wrapping the wires on the anchor means and on the terminals of the bobbins;

a first support member which carries one of the wire guides, the first support member being selectively transferable from a storage position to the orbiting member into a fixed position on the orbiting member;

a second support member for carrying one of the other wire guides, the second support member being slidably mounted on the orbiting member for movement relative to the first wire guide support member when the first wire guide support member is mounted on the orbiting member;

means on the orbiting member for moving the second wire guide support member relative to the first wire guide support member to locate the wire guides on the support members in a spaced relationship essentially corresponding to the spaced relationship of the terminals on the bobbins, and in a spaced relationship essentially corresponding to the spacing between the anchor means for the wire guides, for selectively wrapping wires on the terminals simultaneously, and upon the anchor means simultaneously, upon movement of the orbiting member in the orbital path;

means for moving the orbiting member along the orbital path to wrap the wires on the anchor means and on the terminals of the bobbins;

means for rotating the bobbins to wind the wires on the bobbins;

a first slide mounted for reciprocable movement in first directions;

a plurality of second slides for storing the other wire guides when the other wire guides are not mounted on the second wire guide support member, the second slides being mounted on the first slide for reciprocable movement in second directions perpendicular to the first directions;

means for moving the first slide to locate one of the second slides in a position for transfer of the wire guide on the second slide to the second wire guide support member;

means for moving the second slide which is in the transfer position toward the second wire guide support member to transfer the wire guide on the second slide to the second wire guide support member; and means for precluding movement of the other second slides with the second slide which is in the transfer position.

23. Apparatus as recited in claim 22, which further comprises:

means for changing the radius of orbital movement of the orbiting member.

24. Apparatus as recited in claim 23, which further comprises:

means for breaking the wires in tension closely adjacent the terminals on which the wires are wrapped, the wire breaker means being movable into engagement with the wires closely adjacent the terminals between the terminals and the wire anchor means in a direction essentially perpendicular to the wires.

25. Apparatus as recited in claim 24, which further comprises:

means for stripping scrap wire portions formed on the anchor means by operation of the wire breaker means, from the anchor means.

26. Apparatus as recited in claim 1, in which: the transfer means selectively transfers a plurality of the strand guides from the storage means to the moving means, for winding the strands in the plurality of strand guides on the support member simultaneously.

* * * * *

UNITED STATES PATENT AND TRADEMARK OFFICE

CERTIFICATE OF CORRECTION

PATENT NO. : 4,320,876

DATED : March 23, 1982

INVENTOR(S) : Donald W. Parham, Jr., John G. Tucker

It is certified that error appears in the above-identified patent and that said Letters Patent are hereby corrected as shown below:

Column 1, line 48, after "of" insert --and--. Column 2, line 41, "bobbin" should read --bobbins--. Column 7, line 11, "position" should read --positions--. Column 11, line 8, "movment" should read --movement--. Column 14, lines 11 and 12, "guide shafts 312 supported at their opposite thereof and which receive" should be deleted. Column 24, line 59, "cloes" should read --closes--. Column 25, line 7, "slids" should read --slide--. Column 26, line 44, "dauses" should read --causes--.

In the claims, Column 33, line 10, "S" should be deleted.

Signed and Sealed this

Sixteenth Day of November 1982

[SEAL]

*Attest:*

GERALD J. MOSSINGHOFF

*Attesting Officer* *Commissioner of Patents and Trademarks*